US005648795A

United States Patent [19]

Vouri et al.

[11] Patent Number: 5,648,795

[45] Date of Patent: *Jul. 15, 1997

[54] METHOD OF RESETTING A COMPUTER VIDEO DISPLAY MODE

[75] Inventors: Scott D. Vouri, Petaluma; Paul Jerome Higgins, Sebastopol, both of Calif.

[73] Assignee: Binar Graphics, Inc., San Rafael, Calif.

[ * ] Notice: The term of this patent shall not extend beyond the expiration date of Pat. No. 5,420,605.

[21] Appl. No.: 315,586

[22] Filed: Sep. 30, 1994

Related U.S. Application Data

[63] Continuation of Ser. No. 23,945, Feb. 26, 1993, Pat. No. 5,420,605.

[51] Int. Cl.[6] ..... G09G 3/00

[52] U.S. Cl. ..... 345/132; 395/128

[58] Field of Search ..... 345/132, 153, 345/154, 112, 115, 119, 156; 395/128

[56] References Cited

U.S. PATENT DOCUMENTS

| | | | |
|---|---|---|---|
| 4,672,683 | 6/1987 | Matsueda | 382/57 |
| 4,931,956 | 6/1990 | Stapleton | 364/521 |
| 4,954,970 | 9/1990 | Walker et al. | 364/521 |
| 5,051,929 | 9/1991 | Tutt et al. | 364/521 |
| 5,065,346 | 11/1991 | Kawai et al. | 395/128 |
| 5,119,081 | 6/1992 | Ikehira | 340/723 |
| 5,142,616 | 8/1992 | Kellas et al. | 395/135 |
| 5,179,639 | 1/1993 | Taaffee | 395/128 |
| 5,420,605 | 5/1995 | Vouri et al. | 345/132 |

OTHER PUBLICATIONS

Aldus Photostyler, Jun. 1992, pp. 42–61.

Radio Shack, "Going With Extended Color Basic," pp. 19–23 1981.

Radio Shack, "TRS–80 Color Computer Technical Reference Manual," pp. 21–26, 1981.

W. Barden, Jr., "Color Computer Assembly Language Programming," 1983, p. 235.

*Primary Examiner*—Regina D. Liang

*Attorney, Agent, or Firm*—Hickman Beyer & Weaver

[57] ABSTRACT

A method of resetting the screen display mode in a computer system having a display monitor is disclosed. The method is arranged to reset the display mode while a designated operating system such as a windowing environment based operating system is running, without requiring the operating system or any currently running application(s) to be exited and reloaded. The method includes the step of receiving a user initiated input requesting a change in the display mode. After a display mode request is received, the operating system display characteristic variables are reset to values that are appropriate for the requested display mode. Additionally, the display driver display characteristic variables are reset to values that are appropriate for the requested display mode. Moreover, the hardware mode is set to a mode that is appropriate for the requested display mode. After all of these resetting steps have been completed, the display screen is repented to display the images dictated by any program(s) that is/are currently running in the requested display mode.

58 Claims, 17 Drawing Sheets

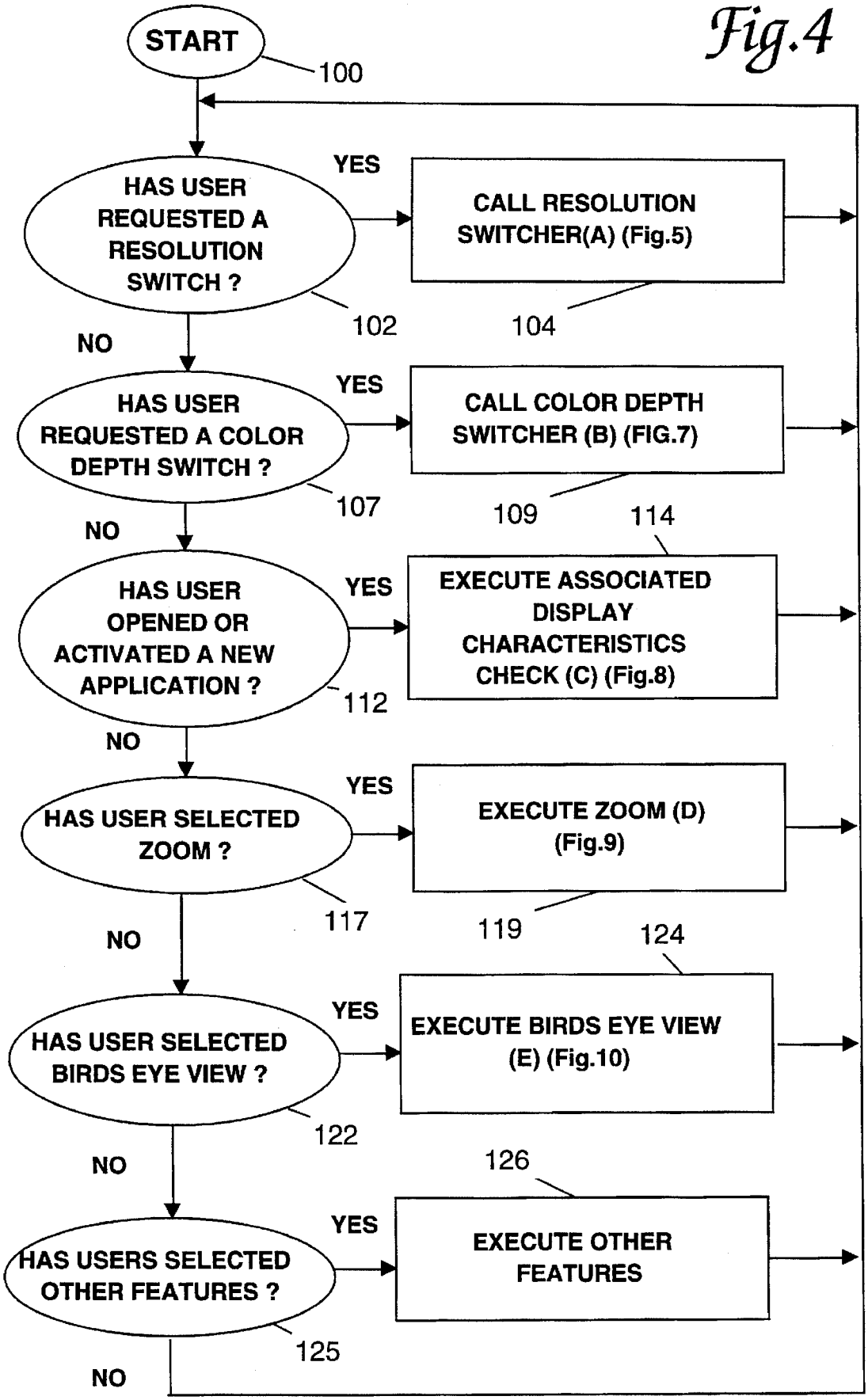
Fig.4
START
100
HAS USER REQUESTED A RESOLUTION SWITCH ?
YES
CALL RESOLUTION SWITCHER(A) (Fig.5)
102
104
NO
HAS USER REQUESTED A COLOR DEPTH SWITCH ?
YES
CALL COLOR DEPTH SWITCHER (B) (FIG.7)
107
109
114
NO
HAS USER OPENED OR ACTIVATED A NEW APPLICATION ?
YES
EXECUTE ASSOCIATED DISPLAY CHARACTERISTICS CHECK (C) (Fig.8)
112
NO
HAS USER SELECTED ZOOM ?
YES
EXECUTE ZOOM (D) (Fig.9)
117
119
124
NO
HAS USER SELECTED BIRDS EYE VIEW ?
YES
EXECUTE BIRDS EYE VIEW (E) (Fig.10)
122
126
NO
HAS USERS SELECTED OTHER FEATURES ?
YES
EXECUTE OTHER FEATURES
125
NO A
GET DESIRED SCREEN RESOLUTION
130
104
IS DESIRED SCREEN RESOLUTION DIFFERENT THAN CURRENT SCREEN RESOLUTION ?
NO
DONE
YES
131
PASS SCREEN SIZE INFORMATION TO DRIVER ROUTINES
132
SET OPERATING SYSTEM SCREEN SIZE VARIABLES (Fig.6)
134
SET DRIVER SCREEN SIZE VARIABLES
136
SET HARDWARE MODE
138
REFRESH SCREEN
140
DONE

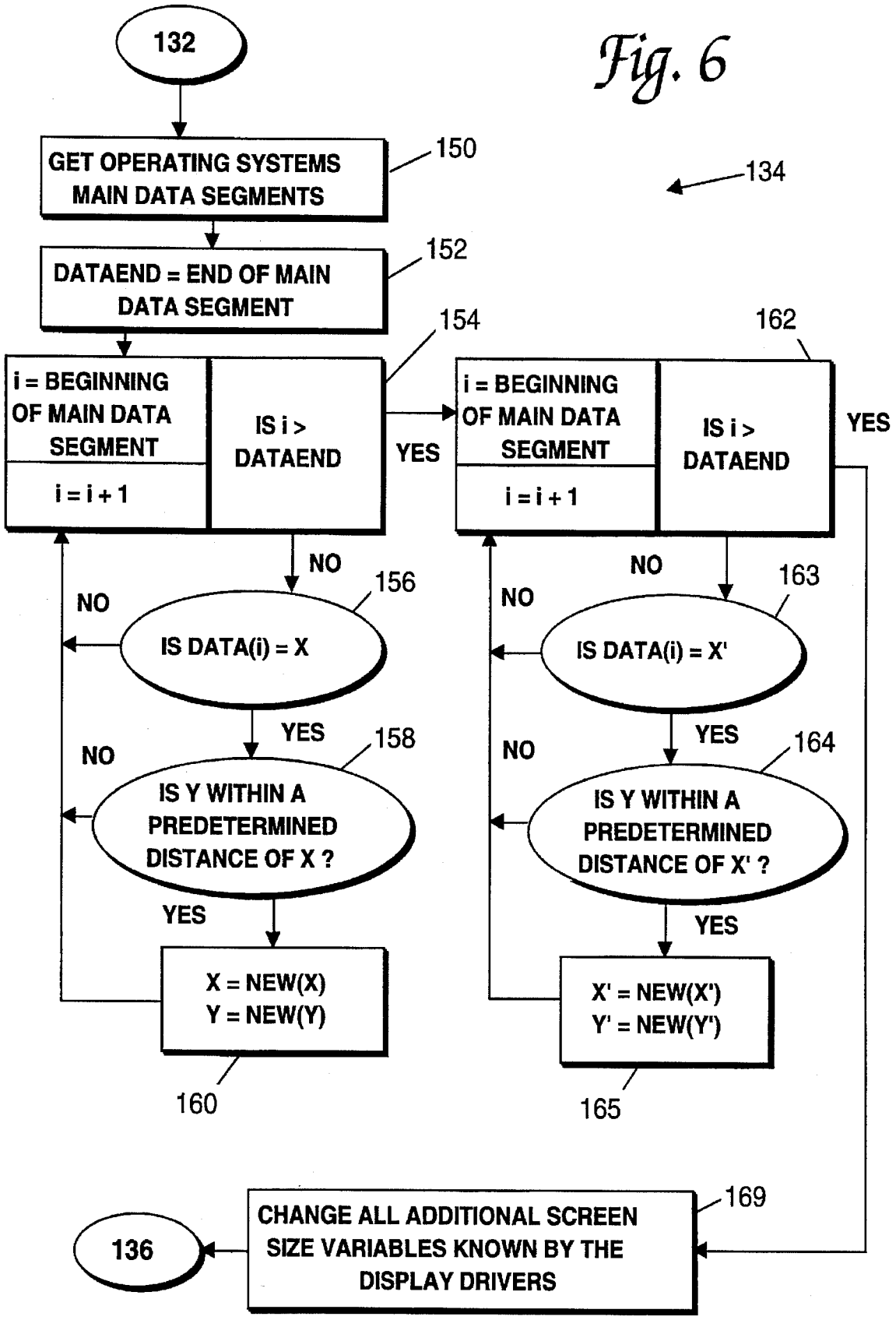
132
Fig. 6
GET OPERATING SYSTEMS MAIN DATA SEGMENTS
150
134
DATAEND = END OF MAIN DATA SEGMENT
152
154
162
i = BEGINNING OF MAIN DATA SEGMENT
i = i + 1
IS i > DATAEND
YES
i = BEGINNING OF MAIN DATA SEGMENT
i = i + 1
IS i > DATAEND
YES
NO
156
NO
IS DATA(i) = X
NO
163
NO
IS DATA(i) = X'
YES
158
NO
IS Y WITHIN A PREDETERMINED DISTANCE OF X ?
YES
X = NEW(X)
Y = NEW(Y)
160
YES
164
NO
IS Y WITHIN A PREDETERMINED DISTANCE OF X' ?
YES
X' = NEW(X')
Y' = NEW(Y')
165
169
136
CHANGE ALL ADDITIONAL SCREEN SIZE VARIABLES KNOWN BY THE DISPLAY DRIVERS

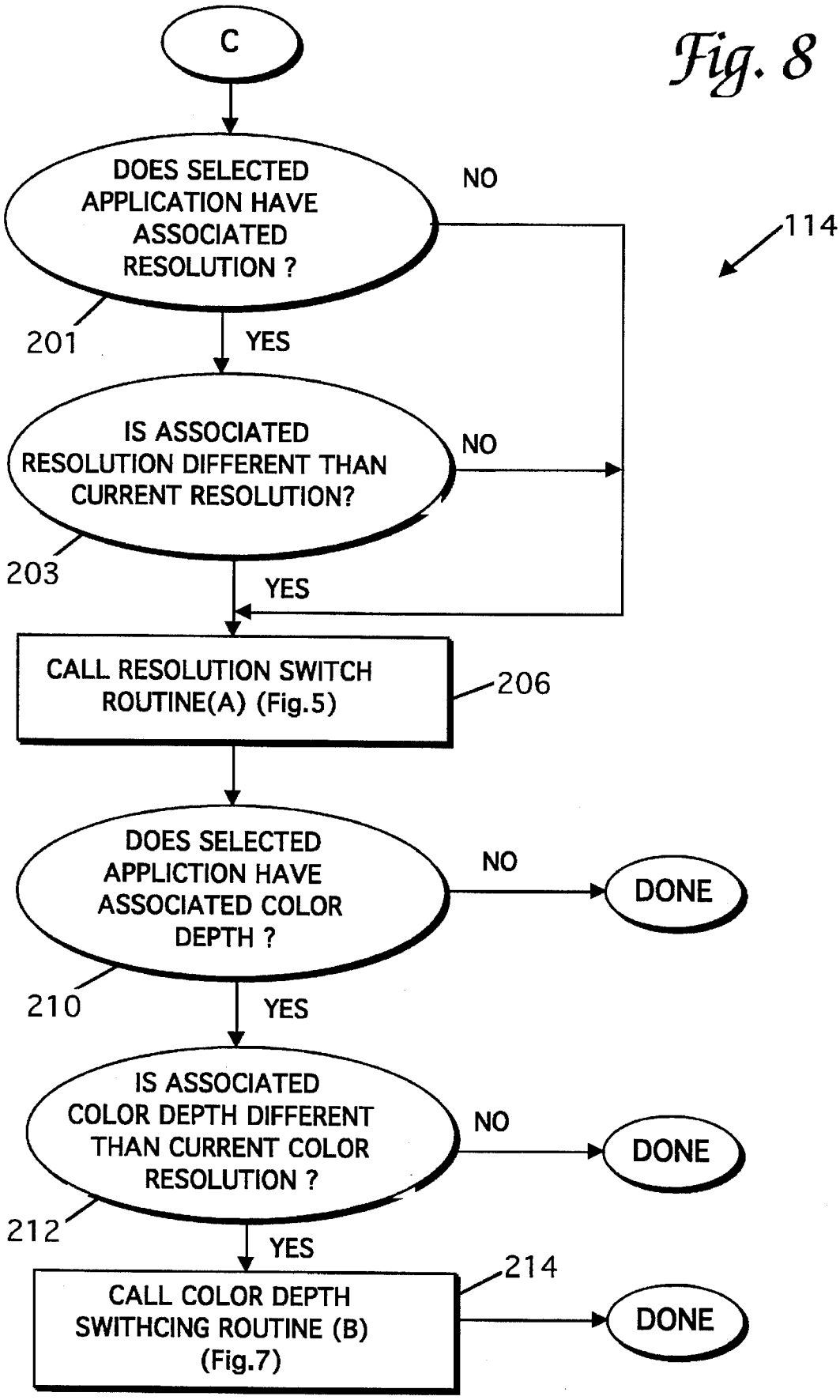
C
Fig. 8
DOES SELECTED APPLICATION HAVE ASSOCIATED RESOLUTION ?
NO
114
201
YES
IS ASSOCIATED RESOLUTION DIFFERENT THAN CURRENT RESOLUTION?
NO
203
YES
CALL RESOLUTION SWITCH ROUTINE(A) (Fig.5)
206
DOES SELECTED APPLICTION HAVE ASSOCIATED COLOR DEPTH ?
NO
DONE
210
YES
IS ASSOCIATED COLOR DEPTH DIFFERENT THAN CURRENT COLOR RESOLUTION ?
NO
DONE
212
YES
214
CALL COLOR DEPTH SWITHCING ROUTINE (B) (Fig.7)
DONE

E

DISPLAY REDUCED VIEW OF ENTIRE DESKTOP IN BIRDS EYE WINDOW
281
124
IS A VALID USER INPUT DETECTED ?
283
NO
YES
HAS A CLOSE OPERATION BEEN DETECTED ?
285
NO
CLOSE REDUCED DISPLAY WINDOW
286
DONE
YES
OBTAIN POINTER POSITION
291
CLOSE BIRDS EYE VIEW WINDOW
293
SET SCREEN ORIGIN POSTION
295
REPAINT SCREEN
297
DONE

Microsoft Excel - BUDGET.XLS

File Edit View Insert Format Tools Data Window Help

Helvetica 14 100%

A1 BUDGET FORECAST

| | A | B | C | D | E | F | G | H | I | J | K | L | M |
|---|---|---|---|---|---|---|---|---|---|---|---|---|---|
| 3 | | | | | | | | | | | | | |
| 4 | Site | Operating Exp | GL # | 6/86 | 7/86 | 8/86 | Q1 | 9/86 | 10/86 | 11/86 | Q2 | S1 | 12/86 |
| 5 | Albany, NY | | | $28,675 | $28,175 | $28,675 | $85,525 | $28,675 | $29,575 | $31,875 | $90,125 | $175,650 | $31,675 |
| 6 | | Salaries | 1-1002 | 10000 | 10000 | 10000 | 30000 | 10000 | 10000 | 13000 | 33000 | 63000 | 12000 |
| 7 | | Supplies | 1-2310 | 3000 | 2500 | 3000 | 8500 | 2500 | 3000 | 2500 | 8000 | 16500 | 3300 |
| 8 | | Equipment | 1-2543 | 4575 | 4575 | 4575 | 13725 | 4575 | 4575 | 4575 | 13725 | 27450 | 4575 |
| 9 | | Lease Pmts | 1-7862 | 9600 | 9600 | 9600 | 28800 | 9600 | 9600 | 9600 | 28800 | 57600 | 9600 |
| 10 | | Advertising | 1-8752 | 1500 | 1500 | 1500 | 4500 | 2000 | 2400 | 2200 | 6600 | 11100 | 2200 |
| 11 | | | | | | | | | | | | | |
| 12 | Memphis, TN | | | $28,200 | $28,200 | $28,200 | $84,600 | $28,200 | $23,400 | $25,900 | $77,500 | $162,100 | $22,900 |
| 13 | | Salaries | 2-1002 | 7500 | 7500 | 7500 | 22500 | 7500 | 7500 | 10000 | 25000 | 47500 | 7500 |
| 14 | | Supplies | 2-2310 | 2000 | 2000 | 2000 | 6000 | 2000 | 2000 | 2000 | 6000 | 12000 | 2000 |
| 15 | | Equipment | 2-2543 | 8000 | 8000 | 8000 | 24000 | 8000 | 2700 | 2700 | 13400 | 37400 | 2700 |
| 16 | | Lease Pmts | 2-7862 | 8200 | 8200 | 8200 | 24600 | 8200 | 8200 | 8200 | 24600 | 49200 | 8200 |
| 17 | | Advertising | 2-8752 | 2500 | 2500 | 2500 | 7500 | 2500 | 3000 | 3000 | 8500 | 16000 | 2500 |
| 18 | | | | | | | | | | | | | |
| 19 | Houston, TX | | | $54,500 | $54,500 | $54,500 | $163,500 | $58,000 | $58,500 | $63,500 | $180,000 | $343,500 | $58,500 |
| 20 | | Salaries | 4-1002 | 20000 | 20000 | 20000 | 60000 | 22000 | 22000 | 27000 | 71000 | 131000 | 22000 |
| 21 | | Supplies | 4-2310 | 5000 | 5000 | 5000 | 15000 | 5000 | 5000 | 5000 | 15000 | 30000 | 5000 |
| 22 | | Equipment | 4-2543 | 9500 | 9500 | 9500 | 28500 | 11000 | 11000 | 11000 | 33000 | 61500 | 11000 |
| 23 | | Lease Pmts | 4-7862 | 17000 | 17000 | 17000 | 51000 | 17000 | 17000 | 17000 | 51000 | 102000 | 17000 |
| 24 | | Advertising | 4-8752 | 3000 | 3000 | 3000 | 9000 | 3000 | 3500 | 3500 | 10000 | 19000 | 3500 |
| 25 | | | | | | | | | | | | | |
| 26 | Boise, ID | | | $27,000 | $27,250 | $27,250 | $81,500 | $27,250 | $27,250 | $27,900 | $82,400 | $163,900 | $27,250 |
| 27 | | Salaries | 3-1002 | 7700 | 7700 | 7700 | 23100 | 7700 | 7700 | 8350 | 23750 | 46850 | 7700 |

BUDGET

Ready NUM

Program Manager

AnyView

60

*Fig. 11b*

METHOD OF RESETTING A COMPUTER VIDEO DISPLAY MODE

This application is a continuation of patent application Ser. No. 08/023,945 filed Feb. 26, 1993 now U.S. Pat. No. 5,420,605 which is incorporated herein by reference in its entirety.

BACKGROUND OF THE INVENTION

The present invention relates generally to resetting the video display in a computer system. More particularly, a method of controlling a video display is described which permits the user to alter display characteristics such as the screen resolution and/or the color depth without requiting that either the currently open application(s) or the operating system be exited and reloaded.

Most modern computer monitors are capable of displaying in a variety of screen resolutions. By way of example, many monitors for personal computers are capable of at least displaying images having resolutions of 640×480, 800×600 and 1024×768 pixels. There are many circumstances in which a user may want to utilize different screen resolutions for different applications. For example, when using a word processor, most users prefer a relatively low screen resolution (such as 640×480) so that the letters appear relatively large and thus are easy to read. On the other hand, when using a spreadsheet having a large number of columns, it may be desirable to switch to a higher resolution (such as 1024×768) so that a more complete view of the spreadsheet can be seen on the screen.

Similarly, the video cards associated with most color monitors are capable of displaying in a variety of different pixel depth modes. That is, they can be arranged to display different numbers of colors. By way of example, video cards capable of displaying 16, 256, or 32K colors are common and many state of the art video cards are capable of displaying as many as 16M or more colors. There are many circumstances in which a user may want to utilize different color (pixel) depths for different applications. For example, when using a word processor, there is little need for using a large number of colors. Therefore, since operating the word processing software at a large color depth (such as 16M colors) slows the operation of the software considerably, it is preferable to run the word processing software at a low color depth (such as 16 or 256 colors). On the other hand, when the user is running imaging software or the like, the use of a higher color depth is highly desirable and is worth the speed losses associated therewith.

In view of the forgoing, users occasionally desire to change the video display mode. Currently, one of the most popular operating systems for IBM PC compatible personal computers is the MS-DOS based Windows operating system marketed by Microsoft Corporation. Within Windows, various video display characteristics such as the screen resolution and color depth are controlled by software based video card screen drivers. Each video card requires a number of dedicated screen drivers. For example, traditionally, a separate video driver has been provided for each screen resolution and color depth that is supported by the video card and monitor. More recently, multi-resolution drivers have been used, however separate drivers for different color depths are still the norm. In order to switch the screen resolution or the color depth, it is typically necessary to exit any open application(s), exit Windows and then change the screen resolution or color depth in DOS. This is typically accomplished by loading a new driver program, or in the case of changing the screen resolution using a multi-resolution driver, the application requesting the new resolution saves the desired resolution values to the disk before exiting Windows. After the new driver has been loaded (or the appropriate resolution values saved), both Windows and the desired application programs must be restarted. Obviously, this procedure is slow and cumbersome and it would be desirable to provide a mechanism that permits the user to alter the screen resolution and/or color depth without having to exit Windows, when Windows is the operating system that is currently running.

SUMMARY OF THE INVENTION

Accordingly, it is a general object of the present invention to provide a mechanism that permits the user to alter display characteristics such as the screen resolution and/or the color depth without requiring that either the currently open application(s) or the operating system be exited and reloaded.

To achieve the foregoing and other objects and in accordance with the purpose of the present invention, a method of resetting the screen display mode in a computer system having a display monitor is disclosed. The method is arranged to reset the display mode while a designated operating system is running, without requiring the operating system or any currently running application(s) to be exited and reloaded. The method includes the step of receiving a user initiated input requesting a change in the display mode. After a display mode request is received, the operating system display characteristic variables are reset to values that are appropriate for the requested display mode. Additionally, the display driver display characteristic variables are reset to values that are appropriate for the requested display mode. Moreover, the hardware mode is set to a mode that is appropriate for the requested display mode. After all of these resetting steps have been completed, the display screen is repainted to display the images dictated by any program(s) that is/are currently running in the requested display mode.

In a preferred embodiment of the invention, the display mode change request asks for a mode change selected from the group consisting of a new display resolution and a new color depth. Further, the user initiated input preferably takes the form of one from the group of selecting an icon associated with the desired display mode, selecting the desired display mode from a menu and selecting a new application having a desired display mode associated therewith that is different from the current display mode.

In another preferred embodiment, when the user initiated input takes the form of selecting a new application having a desired display mode associated therewith, the method further includes the step of checking to determine whether the selected application has a desired display mode associated therewith. When the selected application has a desired display mode associated therewith, the desired display mode is checked to determine whether it is different from the current display mode. If so, the setting and refreshing steps are executed. On the other hand, when the selected application does not have a desired display mode associated therewith and when the selected application has a desired display mode that is the same as the current display mode, the setting and refreshing steps are not executed.

In yet another preferred aspect of the invention, the invention is applied to a windowing environment based operating system.

In an alternative aspect of the invention, a method of temporarily changing the resolution of a screen display of a display monitor in a pointer based computer system is disclosed. The method includes the step of receiving a user initiated input requesting a temporary change in the resolution of the screen display. When such an input request is received, the hardware mode is set to the requested screen resolution without changing any screen size variables in either the operating system or the display driver. A new screen origin is then determined based upon the nature of the user input and the display screen is refreshed to display the images dictated by a program that is currently running in the requested screen resolution. When a clearing user input is detected, the hardware mode is restored to the original screen resolution while the screen origin is restored to the original screen origin. Thereafter, the display screen is again refreshed to display the appropriate images in the original screen resolution.

BRIEF DESCRIPTION OF THE DRAWINGS

The invention, together with further objects and advantages thereof, may best be understood by reference to the following description taken in conjunction with the accompanying drawings in which:

FIG. 4 is a flow diagram illustrating a method suitable for executing the various aspects of the present invention.

FIG. 6 is a flow diagram illustrating the operating system screen size variables setting step during screen resolution switching.

FIG. 8 is a flow diagram illustrating the screen resolution and color depth checking process that occurs when a new application is selected or activated.

FIG. 11*b* is a screen display of a Windows session running the application program shown in FIG. 11*a* after a resolution switch to a 1024×768 screen resolution.

DETAILED DESCRIPTION OF THE INVENTION

Figure 1:
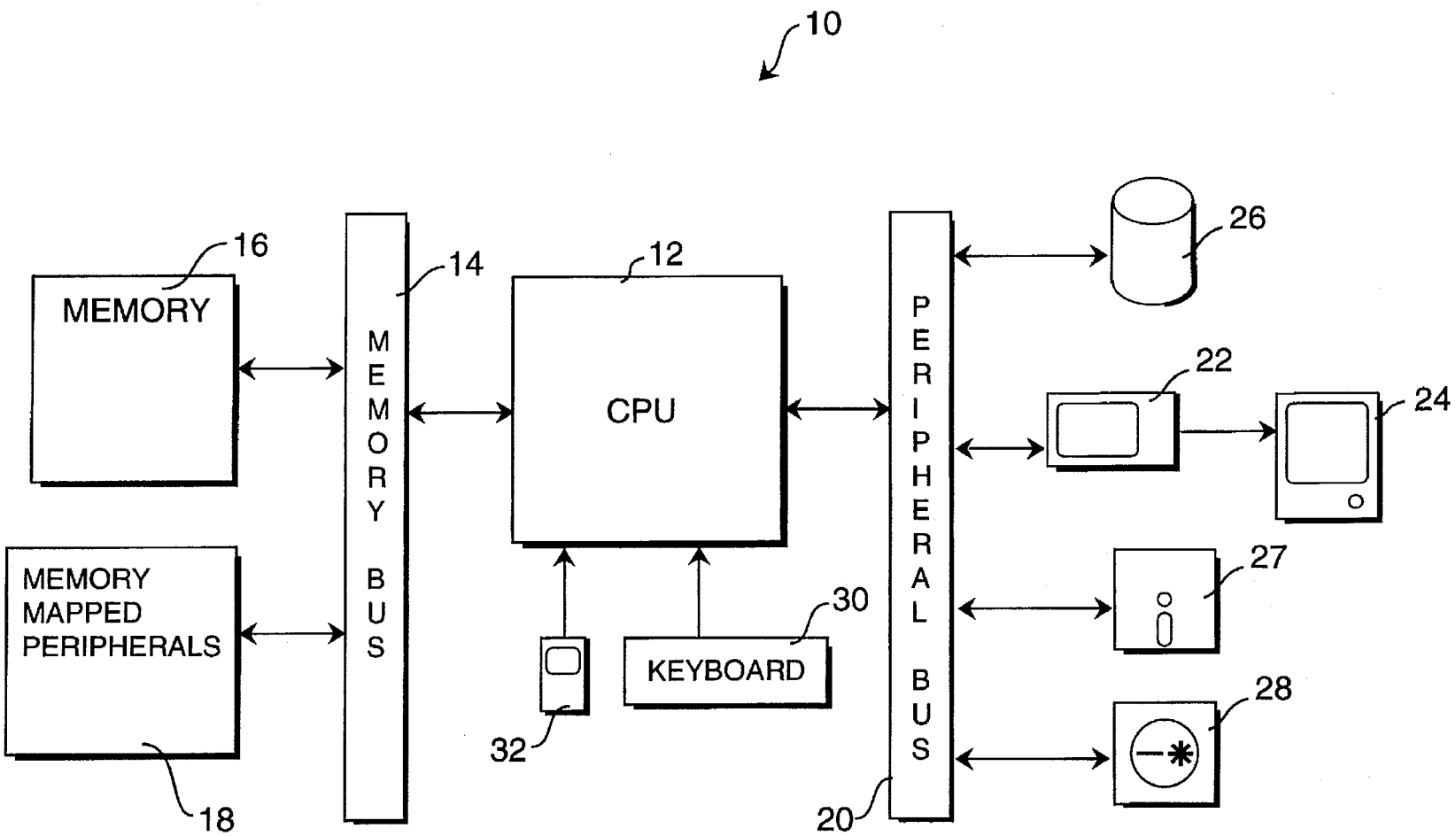
FIG. 1 is a block diagram of a computer system that is suitable for operating the present invention.

As shown in FIG. 1, a computer system 10 suitable for executing the present invention includes a central processing unit (CPU) 12, a bidirectional memory bus 14 which couples the CPU to memory 16 and memory mapped peripherals 18, and a bidirectional peripheral bus 20 which connects the CPU to a variety of peripheral devices. The memory 14 typically takes the form of both read only memory (ROM) and random access memory (RAM). Memory mapped peripherals typically include video adapters and data storage devices. A variety of peripheral devices can be coupled to the peripheral bus 20. By way of example, peripherals devices that are frequently connected to the peripheral bus include a video card 22 which controls a display monitor 24, a Winchester type hard disc drive 26, a floppy disc drive 27 and/or CD ROM 28. Additionally, a keyboard 30 and a pointer device 32 such as a mouse or track ball are typically connected directly to the CPU 12. Both the keyboard and the pointer device are arranged to function as user input devices. As will be appreciated by those skilled in the art, a wide variety of other peripheral devices can be connected to either the peripheral bus or the memory bus and the buses which connect the described peripherals to the CPU can be switched and/or additional buses can be added.

The video display controlling utility of the present invention may be applied to a variety of computer systems running a variety of different operating systems. However, for the purposes of illustration the described embodiment will take the form of a utility program for use with a personal computer that is executing an MS-DOS based graphical user interface (GUI) based "Windows" operating system marketed by Microsoft Corporation. Accordingly, the described embodiment is icon-based which gives the user quick access to its most often used features.

The described embodiment of the present invention is divided into portions. The first portion includes the user interface which is based in an application program. For the purposes of the description that follows, a general familiarity with the "Microsoft Windows Software Developers Kit," (SDK) version 3.1 (1992) which is published by Microsoft Corp. is assumed. The second portion of the invention is based in the display driver and is required to facilitate communication with the computer hardware. For the purposes of the description, a general familiarity of the "Microsoft Windows Device Drivers Developers Kit", (DDK) 3.1 (1992) which is published by Microsoft Corp. is assumed. Additionally, as is well know to those skilled in the device driver programming for Windows art, the reference "Undocumented Windows" written by Schulman et al. and published by Addison Wesley in 1992 is a great help when writing driver level code and a generally familiarity with its contents is assumed. Each of these references is incorporated herein by reference. Familiarity with the programming in the Windows operating system environment will be assumed for the purposes of this application.

Figure 2:
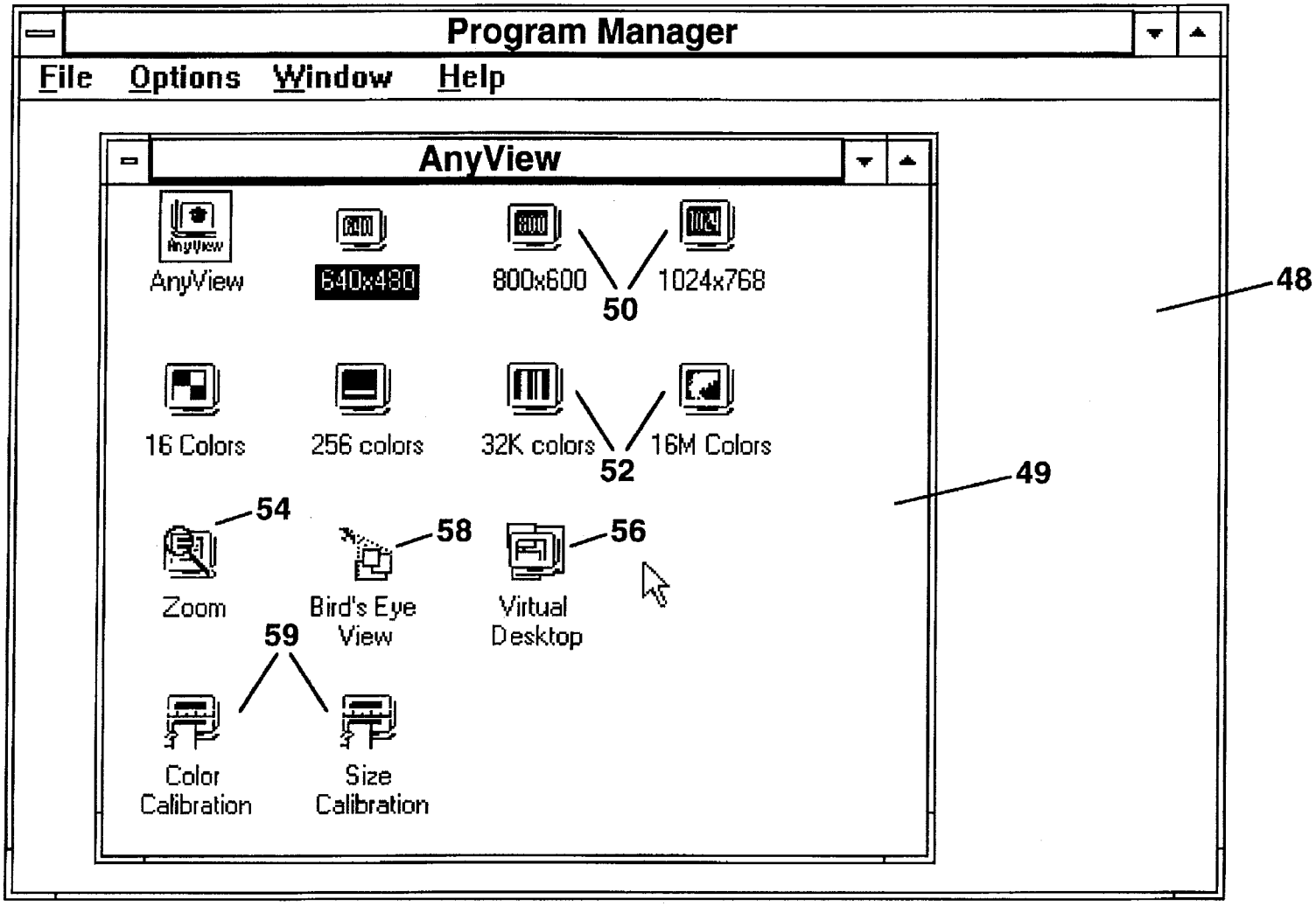
FIG. 2 is a screen display showing a representative opened window that contains a Windows based user interface for a computer display mode controlling utility in accordance with the present invention.

The application program based icon interface portion of the present invention is stored in the program manager window 48 of Windows. The utility window 49 that contains the utilities of the present invention is referred to as the Anyview™ utility window in the drawings. As seen in FIG. 2, the utility window 49 has a multiplicity of icons therein that can be selected by the user to select specific features of the present invention. By way of example, the utility window 49 may include a plurality of screen resolution icons 50, a plurality of color depth icons 52, a zoom icon 54, a virtual desktop icon 56, a bird's eye view icon 58, and other icons 59 which permit the user to control the video display in other manners. A separate screen resolution icon 50 is provided for each screen resolution which is supported by the particular display monitor that is used in the computer system on which the video display controlling utility is installed. By way of example, in the embodiment shown in the drawings, the display monitor supports three screen resolutions. They include 640×480, 800×600 and 1024×768 pixel display resolutions. In order to select a particular screen resolution, the user only needs to select the icon associated with the desired resolution. As described below, when a desired resolution is selected that is different from the current resolution, the utility will automatically change the screen resolution without affecting any application(s) that is/are currently open and without requiring the user to exit Windows.

Like the screen resolution icons, a separate color depth icon 52 is provided by each color depth that is supported by the display monitor/video card. In the described embodiment, the hardware (i.e. the monitor and video card) support four different color depths and thus four color depth icons are provided. They include 16 colors, 256 colors, 32K colors and 16M colors. In order to select a particular color depth, the user only needs to select the icon associated with the desired color depth. When a desired color depth is selected that is different from the current color depth, the utility will automatically change the monitor's color depth without affecting any application(s) that is/are currently open and without requiring the user to exit Windows.

Figure 3:
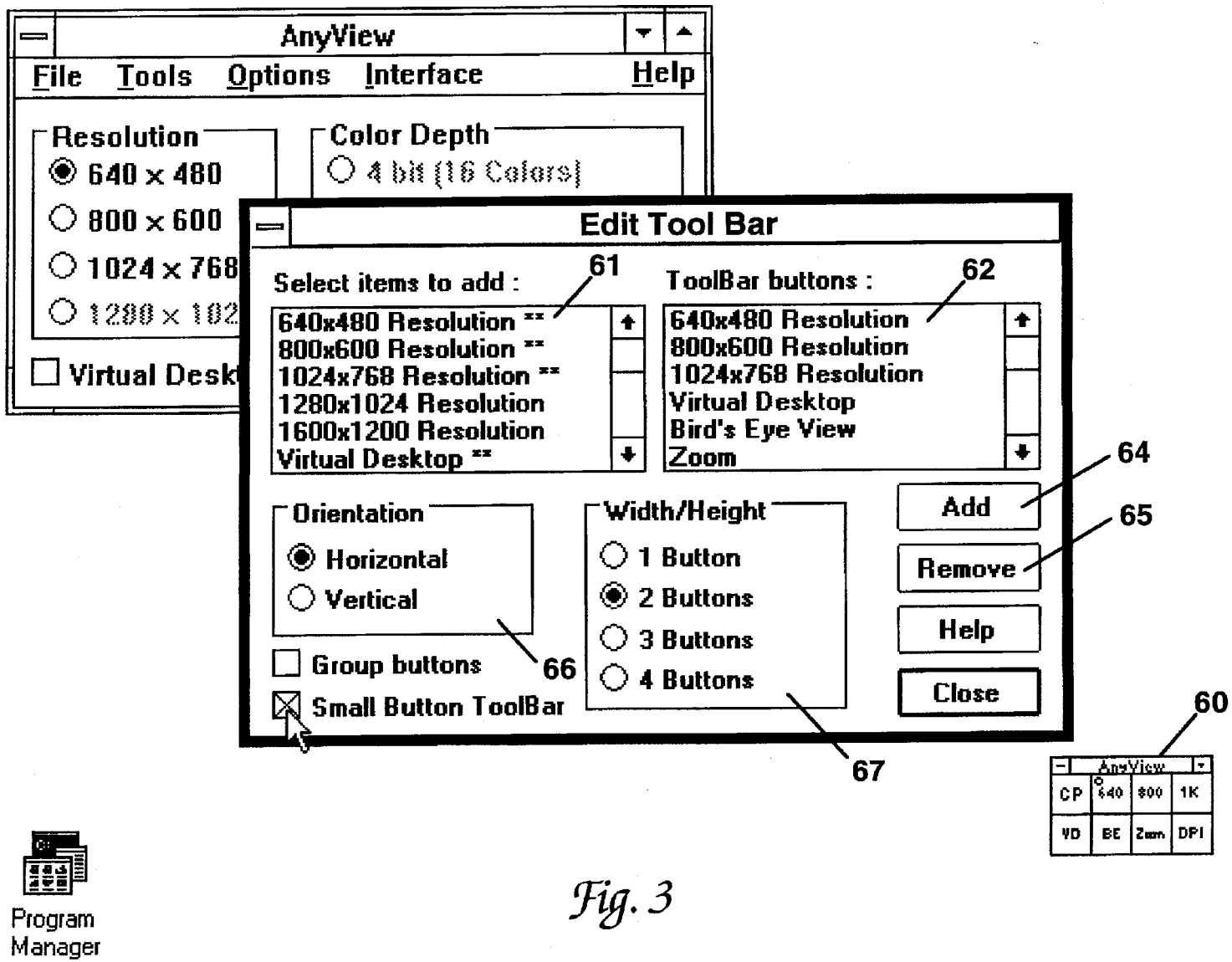
FIG. 3 is a screen display showing a toolbar user interface embodiment in accordance with the present invention.

In addition to the icon based user interface described above, a toolbar 60 is provided. The user may optionally have the toolbar displayed at all times. The toolbar 60 has a number of icons therein. The user is permitted to add any of the icons in the utility window 49 to the toolbar. When the user selects an icon in the toolbar, the corresponding function is executed just as if the icon has been selected from the utility window 49. The user is provided with a mechanism adding icons to and removing icons from the toolbar. The toolbar editing interface is opened by selecting an appropriate editing command from a pull down menu which displays a dialog box as shown in FIG. 3. As seen therein, the toolbar editing interface includes a choice menu 61, a toolbar menu 62, an add button 64, a remove button 65 an orientation selection box 66 and a width/height selection box 67. The user can add items to the toolbar either by selecting an item to be added from a choice menu 61 and clicking on the add button 64 or by dragging the selected item into the toolbar menu 62. Similarly, an item can be removed from the toolbar by selecting an item to be removed from the toolbar menu 62 and either clicking on the remove button 65 or by dragging the selected item into the choice menu 61. Alternatively, the toolbar can be edited by selecting an item from the utility window 49 and dragging it into the toolbar.

The zoom icon 54 is intended to give the user the ability to temporarily enlarge the image displayed on the screen by doing a hardware based temporary resolution switch. In the described embodiment, the screen resolution is switched to 320×200 when zoom is selected and is returned to its original resolution when the zoom is cleared. The zoom operation is initiated by selecting the zoom icon from either the utility window 49 or the tool bar.

When the zoom icon is selected, an enlarged image of the text will be displayed, with the screen origin for the enlarged image being a function of the cursor position. In the described embodiment, the screen origin will normally be at the cursor location. However, when the cursor is positioned close enough to the right or bottom edge of the display, the screen origin will be adjusted so that a full screen is displayed with the appropriate edge of the desktop being substantially adjacent the edge of the screen.

Referring next to FIGS. 4–10, a method of controlling various monitor display characteristics such as the resolution and color depth of a display screen in accordance with the present invention will be described. Turning initially to FIG. 4, the process begins at step 100. In step 102, the logic determines whether resolution switching has been selected. This can be done by checking whether one of the screen resolution icons 50 has been selected. If so, a resolution switching routine is called and executed in step 104 as will be further described below with reference to FIGS. 5 and 6. If not, the logic moves to step 107 where it determines whether color depth switching has been selected. If color depth switching has been selected, then in step 109 a color depth switching routine is called and executed as will be further described below with reference to FIG. 7. If a color depth switching routine has not been selected, then in step 112, the logic determines whether a new application has been selected. If so, the logic calls and executes an associated display characteristics check 114 as will be further described below with reference to FIG. 8.

If a new application has not been selected, then the logic moves to step 117 where it determines whether a zoom operation has been selected. If so, then the zoom operation is called and executed in step 119. If a zoom operation has not be selected, then in step 122 the logic checks to see whether a birds eye view operation has been selected. If so, a birds eye view operation is called and executed in step 124 as will be further described below with reference to FIG. 9. If a birds eye view operation has not been selected, then in step 125 the logic determines whether the user has selected any other feature. If so, the appropriate routine associated with the selected feature is called and executed in step 126. If not, the logic returns to the beginning at step 100 where the function checking steps are repeated until one of the designated functions has been selected. Similarly, after each of steps 104, 109, 114, 119, 124 and 126 have been completed, the logic returns to the beginning at step 100 where the function checking steps are repeated until one of the designated functions has been selected.

In the foregoing explanation the process has been described as if the checking routine is serial in nature and constantly running. However, as will be appreciated by those skilled in the art, in practice such a checking algorithm is not specifically required. Rather, in practice, the various described functions (i.e. steps 104, 109, 114, 119, 124 and 126) are call routines which are executed when called. One way to call several of the functions (i.e. steps 104, 109, 119, 124 and 126) is to selected their associated icon (which may be in utility window 49, the toolbar 60 or in other locations supported by Windows). Alternatively, they could be called by selecting a menu item in a pull down menu, by keyboard commands or in any other suitable manner. In the case of the display characteristics checking routine, 114, the call routine is called whenever a new applications is opened or an open application is activated (i.e. when two or more applications are open and control switches from one to another).

Figure 5:
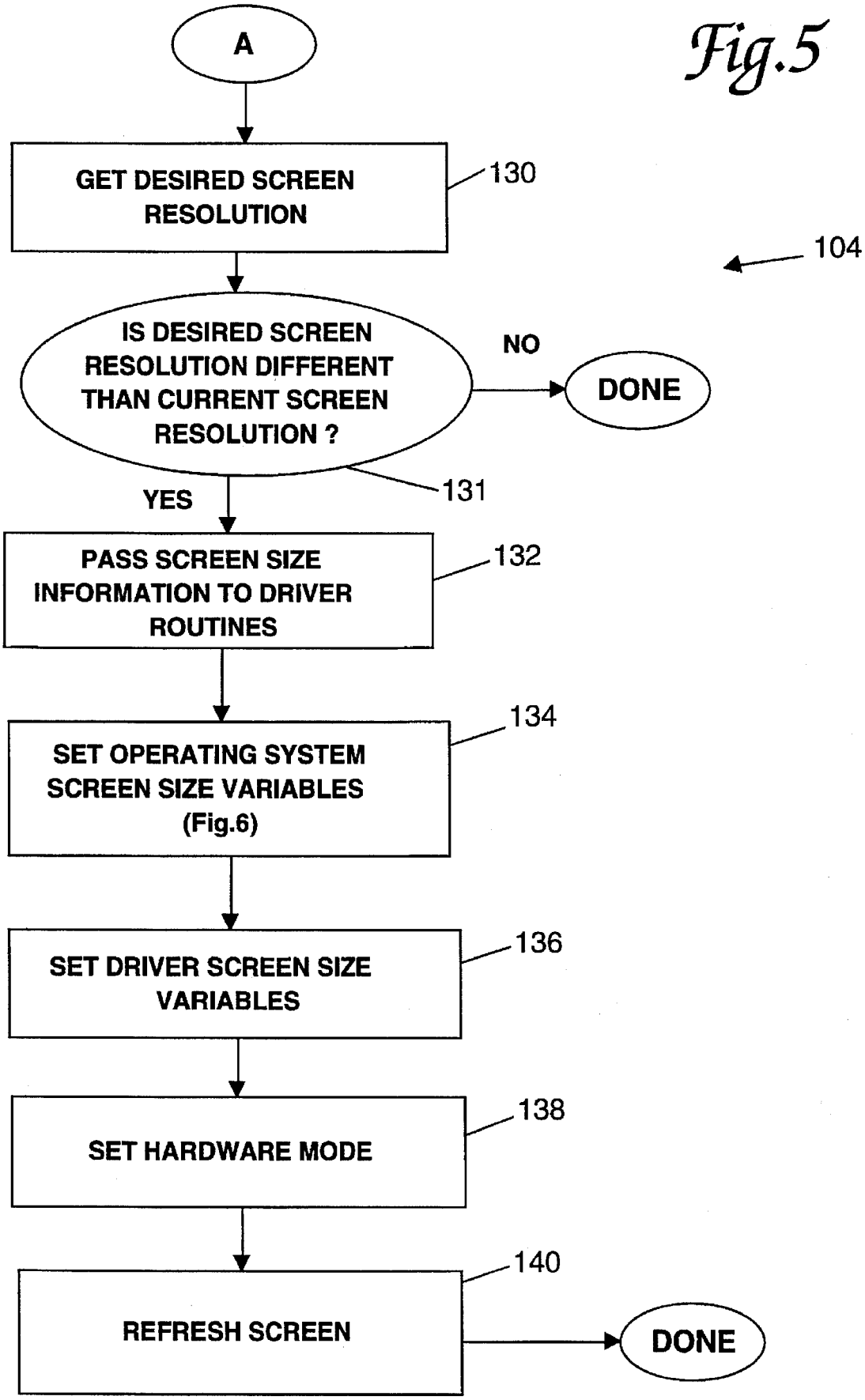
FIG. 5 is a flow diagram illustrating the process executed in order to switch the screen resolution.

Turning next to FIG. 5, the resolution switching routine 104 will be described in more detail. Once the resolution switching routine has been called, in step 130, the logic determines the desired screen size. When the resolution switching routine has been called by selecting a screen resolution icon 50 in either the tool bar 60 or the utility window 49, the desired screen size is determined by the particular icon that is selected by the user. That is, if the 640×480 icon has been selected, the values 640 and 480 define the desired screen size. When the resolution switching routine has been called by the display characteristics checking routine after a new application having an associated resolution that is different than the current resolution has been opened, then the desired screen size is dictated by the screen resolution associated with the newly selected application. Of course, alternative input systems could be substituted for these steps as well. For example, a system which prompts the user to input the desired screen resolution after a screen resolution switch has been requested could be used.

Once the screen size information has been determined in step 130, the logic determines whether the requested screen resolution is different than the current resolution in step 131. If not, the process is done. If so, the screen size information is passed to the driver routines in step 132. From this point on, the resolution switching routine is executed from within the display driver. Within the display driver, the logic initially sets the operating system's screen size variables to values indicative of the desired new screen resolution. Step 134. Then, in step 136, the display driver's screen size variables are set to values indicative of the desired new screen resolution. Thereafter, in step 138, the hardware mode is set to the desired new screen resolution. Once the hardware mode has been set, a refresh screen command is sent to the application program (Windows) in step 140, which causes the screen to display in the newly selected resolution. The screen resolution switching is then completed and the logic returns to its source.

As indicated above, the process for switching screen resolution is logically straight forward. The primary difficulty one encounters when implementing this routine is insuring that all of the screen size variables in both the operating system and the driver are detected and changed. If the location of such variables is known to the programmer, then it is easy to make the appropriate changes. On the other hand, if the location of such variables is not known, then it may take some effort to detect all of the locations which include screen size variables. Unfortunately, the Windows operating system's use of screen size variables is relatively convoluted and the applicants are not aware of any published documents that indicate the location of the screen size variables in Windows. Therefore, a searching technique is used in step 134 to locate and change the operating system's screen size variables as will be described with reference to FIG. 6. It should be appreciated that this searching process can be simplified considerably in systems wherein the location of all of the screen size variables are known and readily accessed.

As seen in FIG. 6, the logic initially gets the operating system's main data segments in step 150. In Windows, this involves getting the USER and GDI main data segments. In step 152, a value DATAEND is set to the end of the selected main data segment. Then in steps 154 through 160, a loop is conducted to detect and change all screen size variables in the selected main data segments. Initially a counter "i" is initialized to the beginning of the data segment. This initial location will of course depend on the location of the searched data segment, and for the purposes of illustration will be considered zero. In step 154 the value of "i" is compared to the value of the variable DATAEND, which indicates the location of the end of the selected main data segment. As long as the value of counter "i" is not greater than the value of variable DATAEND, the logic proceeds to step 156 where it determines whether the value in location "i" is equal to the screen size value "X". That is, is the value in location "i" equal to the number of pixels in the horizontal direction of the current screen size. If not, the logic returns to step 154 where the counter "i" is incremented and the loop repeated. If the value in location "i" is equal to screen size "X", then the logic moves to step 158 where it determines whether a value screen size "Y" is within a predetermined distance of the detected value equal to screen size "X". If a value equal to screen size "Y" is located within a predetermined distance of the value of screen size "X", then it is assumed that these two values are intended to represent the screen size in the operating system and the values X and Y are changed to the new screen sized values [New(X) and New(Y)] in step 160. After the screen size values have been changed in step 160 or after the logic determines that the value screen size "Y" is not within a predetermined distance of the detected value equivalent to screen size "X", then the logic returns to step 154 where the counter "i" is incremented. As long as the value of counter "i" is not greater than or equal to the value of variable DATAEND, the loop will be continued. However, when the value of counter "i" becomes greater than the value of variable DATAEND, the main data segments have been fully searched, the loop is completed and the logic moves on to step 162.

The applicants have found that in Windows, there are numerous occurrences of the screen size data within the USER and GDI main data segments and that they are not always located adjacent one another. A suitable predetermined distance between screen size "X" and screen size "Y" has been found to be equal to two words. That is, if values equal to the existing screen resolution in the X and Y directions are located within two words of each other, they represent screen size data and should be changed. Of course, in other operating systems, it is possible that the screen size data may be separated by different amounts.

After the screen size loop has been completed, similar loops are conducted for any other screen size dependent variables (X', Y') that may be found in the main data segments (if any other such screen size dependent variables exist). In the described Windows embodiment, the main data segments also contain values equal to the size of a maximized window. The maximized window size is equal to the screen size (in each direction) plus eight. Therefore, other screen size dependent variables (X', Y') searched for in Windows include "X+8" and "Y+8". With other operating systems, it is of course possible that other screen size dependent variables would exist which would need to be changed. As seen in steps 162–165, the screen size dependent variable search (or searches) may be identical to the described search loop for the screen size values. Of course, it is possible that the predetermined distance between screen size dependent variables may be somewhat different then the screen sized variables themselves. However, in the described Windows embodiment, the predetermined distance of two words remains the same.

After the main data segments have been searched for all screen size variables and all screen size dependent variables, any additional screen sized variables (and screen sized dependent variables—if any) that are in locations known to the display drivers are changed in step 169. In Windows, such additional screen sized variables are located in the P device structure, the GDI Info structure and the mouse rectangle boundaries. If the location of these additional screen sized variables are not known or subject to change, then they can be searched for and changed in a manner similar to the way that the main data segments are searched as described above. However, if the locations are known, it is easier to go in and make the changes directly in step 169. Once all of the screen size and screen size dependent variables found within the operating system software have been changed, the operating system screen size variable setting step 134 has been completed and the logic proceeds to step 136 where the driver screen size variables are set.

Typically, the driver's screen size variables will be fewer in number and more defined in position than those of the operating system. If the location of the screen size variables are known, they can be readily changed. If they are not generally known, the programmers can typically find them after studying the driver programs. By way of example, in driver programs written by Binar Graphics, Inc. for PC compatible computers, the screen size variables are located in the driver's data segment at offsets defined by variables in the source code.

Figure 7:
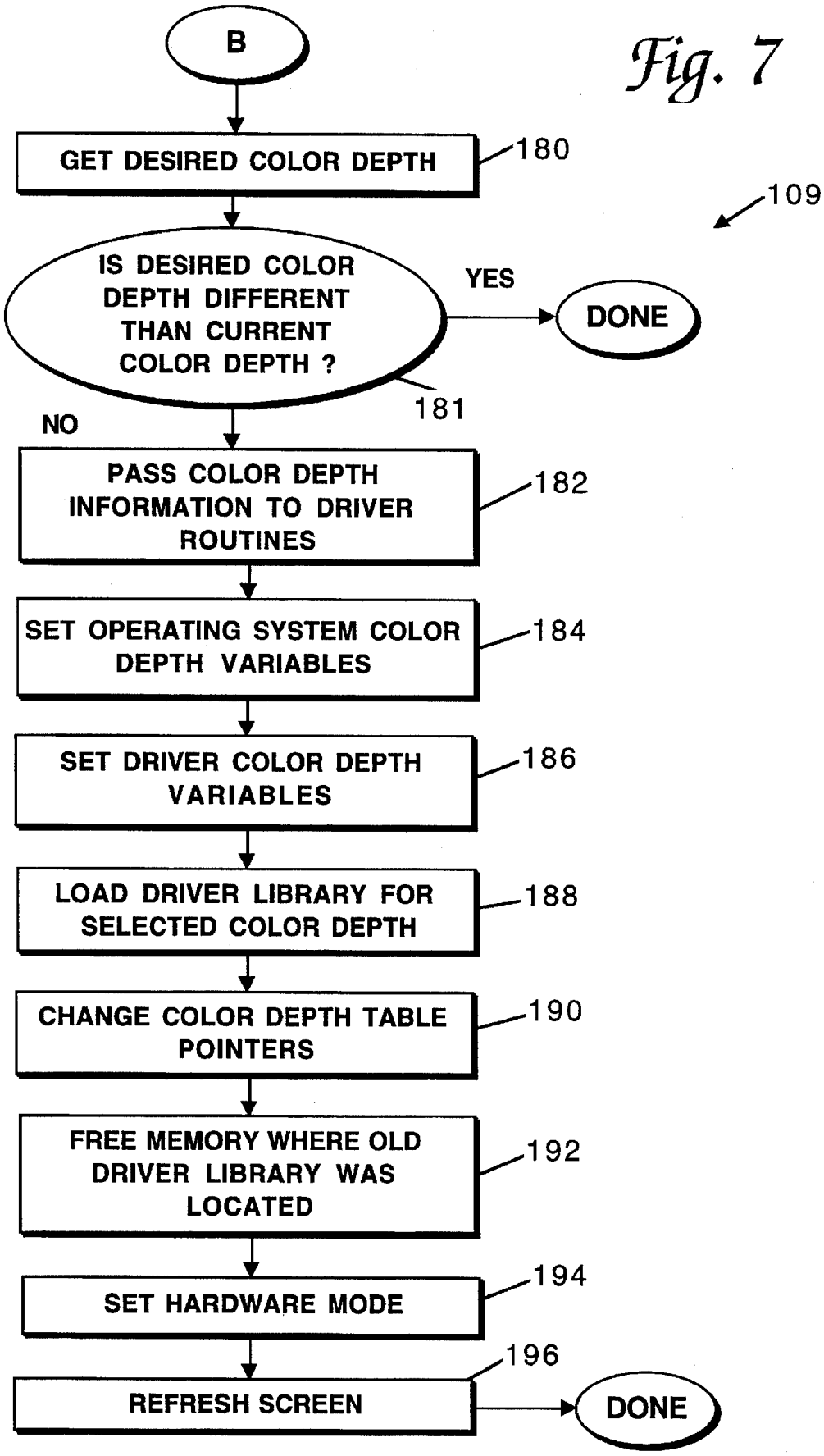
FIG. 7 is a flow diagram illustrating the process executed in order to switch the screen color depth.

Referring next to FIG. 7, the color depth switching step 109 will be described in more detail. Once the color depth switching routine has been called, in step 180, the logic determines the desired color depth. In the described Windows embodiment, the color depth is determined by the display driver that is currently being used. To initiate a change in the color depth, the system will effectively change the driver that is in use. When the color depth switching routine has been called by selecting an icon in either the tool bar 60 or the a utility window 49, then the desired color depth is the depth associated with the particular icon that was selected by the user. When the color depth switching routine has been called by the display characteristic checking routine 114 after a new application having an associated color depth has been opened, then the desired color depth is dictated by the newly opened application.

Once the color depth information has been determined the logic checks to determine whether the desired color depth is different than the current color depth in step 181. If not, the routine is completed. If so, the color depth information is passed to the driver routines in step 182. From this point on, the color depth switching routine is executed from within the display driver. Within the display driver, the logic initially sets the operating system's color depth variables to values indicative of the desired new color depth. Step 184. Then, in step 186, the display driver's color depth variables are set to values indicative of the desired new color depth. Thereafter, in step 188, the driver library for the selected color depth is loaded. The pointers in the color depth table are then reset in step 190 and the memory where the old driver library was located is freed in step 192. Thereafter, the hardware mode is set to the desired new color depth in step 194. Once the hardware mode has been set, a refresh screen command is sent to the application program (Windows) in step 196, which causes the screen to display in the newly selected color depth. The color depth switching is then completed and the logic returns to its source.

Like in the resolution switching step, two of the key steps are to set the color depth variables in the operating system (step 184) and in the driver (step 186). In the described embodiment, the driver is set up somewhat different than many display drivers. Specifically, at Windows run time, only a small section of code with a pointer table is installed. The bulk of the code is saved in driver "libraries" such that each supported color depth has a unique library. Thereafter, when Windows makes its first call to the driver, the driver library for the selected color depth is loaded and initialized. The described driver installation technique is particularly well suited for use with the present invention since it greatly simplifies the driver information that must be reset in order to change the color depth. Specifically only one indication of the selected color depth needs to be changed in step 186 and the pointers need to be changed to reflect the new selected driver library. On the other hand, in other driver setups, the color depth information could be reset in different ways.

Turning next to FIG. 8, the display characteristics checking and revising step 114 that occurs when a new application is selected or activated will be described in more detail. In the described embodiment, anytime a new application is opened or an application that is open comes into the foreground, a display characteristics lookup table is checked to determine whether the resolution and/or color depth needs to be changed. The lookup table includes a list of each application that has at least one associated display characteristic, together with and indication of the associated display characteristic. Initially, in step 201, the logic determines whether the selected application has an associated resolution. To accomplished this, the lookup table is checked to determine whether it has the active application therein, if so, the logic checks to determine whether the active application has an associated resolution. If no associated resolution is found, the logic jumps to step 210 were it determines whether the selected application has an associated color depth as will be described in more detail below. If the newly active application does have an associated resolution, then in step 203, the logic determines whether the associated resolution is different than the current resolution. If the two are the same, then again the logic jumps to step 210. On the other hand, if the resolution associated with the selected application is different from the current resolution, then in step 206, the resolution switching routine 104 is called and executed as described above with reference to FIGS. 5 and 6. In this case, the desired screen size obtained in step 130 is taken from the predetermined resolution associated with the newly opened application. Once the resolution has been changed in step 206, the logic moves on to step 210.

In step 210, the logic determines whether the selected application has an associated color depth. If so, in step 212, the logic determines whether the color depth associated with the newly selected application is different than the current color resolution. If so, in step 214, the color depth switching routine 109 is called and executed as described above with reference to FIG. 7. In this case, the desired color depth obtained in step 180 is taken from the predetermined color depth associated with the newly opened application. Once the color depth has been changed in step 214, the display checking and revising step is done. Similarly, if in step 210 the logic determines that the application does not have an associated color depth or in step 212, the logic determines that the currently selected color depth is the same as the color depth associated with the newly selected application, then the display checking and revising step is done.

Figure 13:
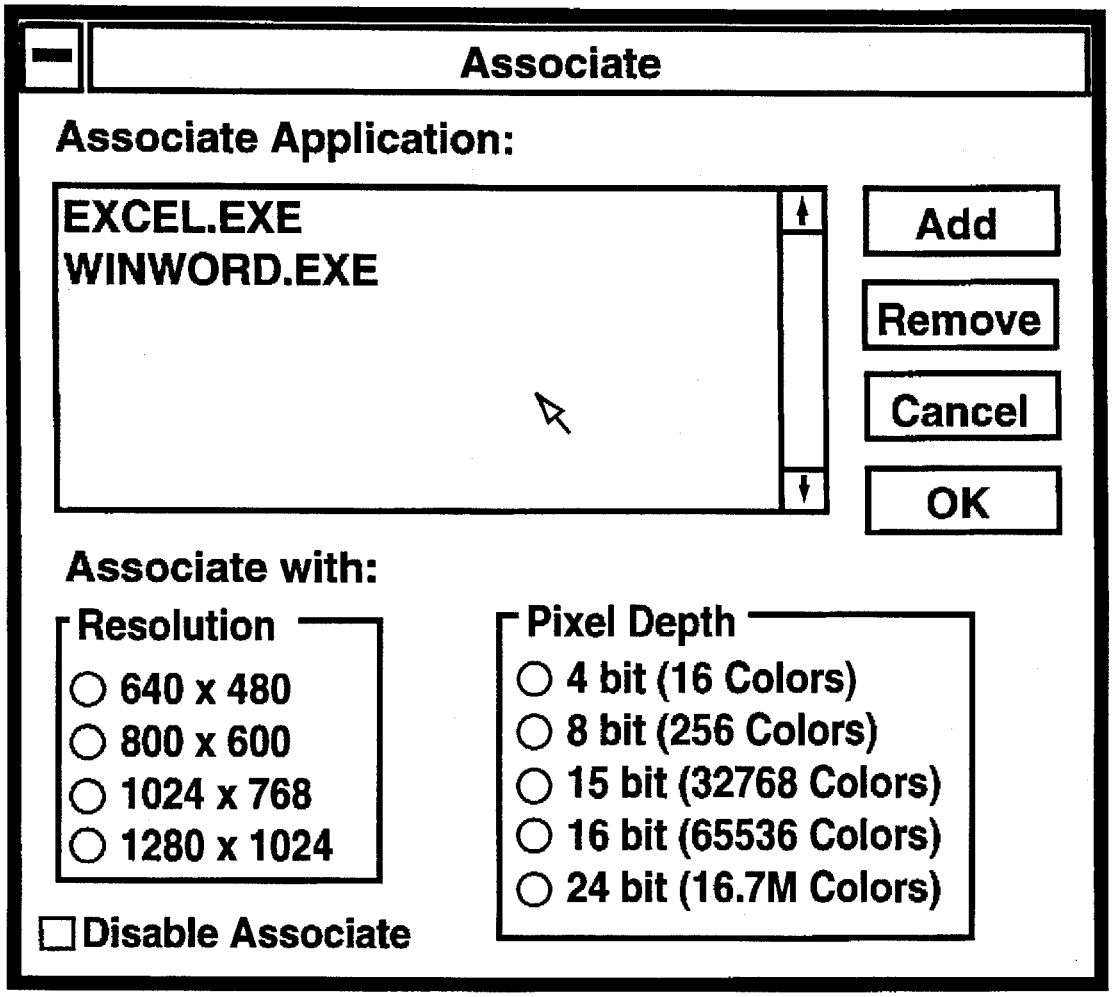
FIG. 13 is a dialog box for editing the associated display characteristics table.

In the described embodiment, the resolution and color depth checking occurs each time a new application is opened, as well as each time that the user shifts between active applications when two or more applications are open on the desktop at the same time. In order to create the associated display characteristics table, a dialog box is provided which can be accessed from a pull down menu that is accessible when the display characteristics controlling utility is opened. A representative dialog box is shown in FIG. 13. As seen therein, the user can list any application in the associated display characteristics table. When a listed application is selected, its associated resolution can be selected by selecting the appropriate desired resolution from the Resolution box and its associated color depth can be selected by selecting the appropriate desired color depth from the Pixel Depth box.

Figure 9:
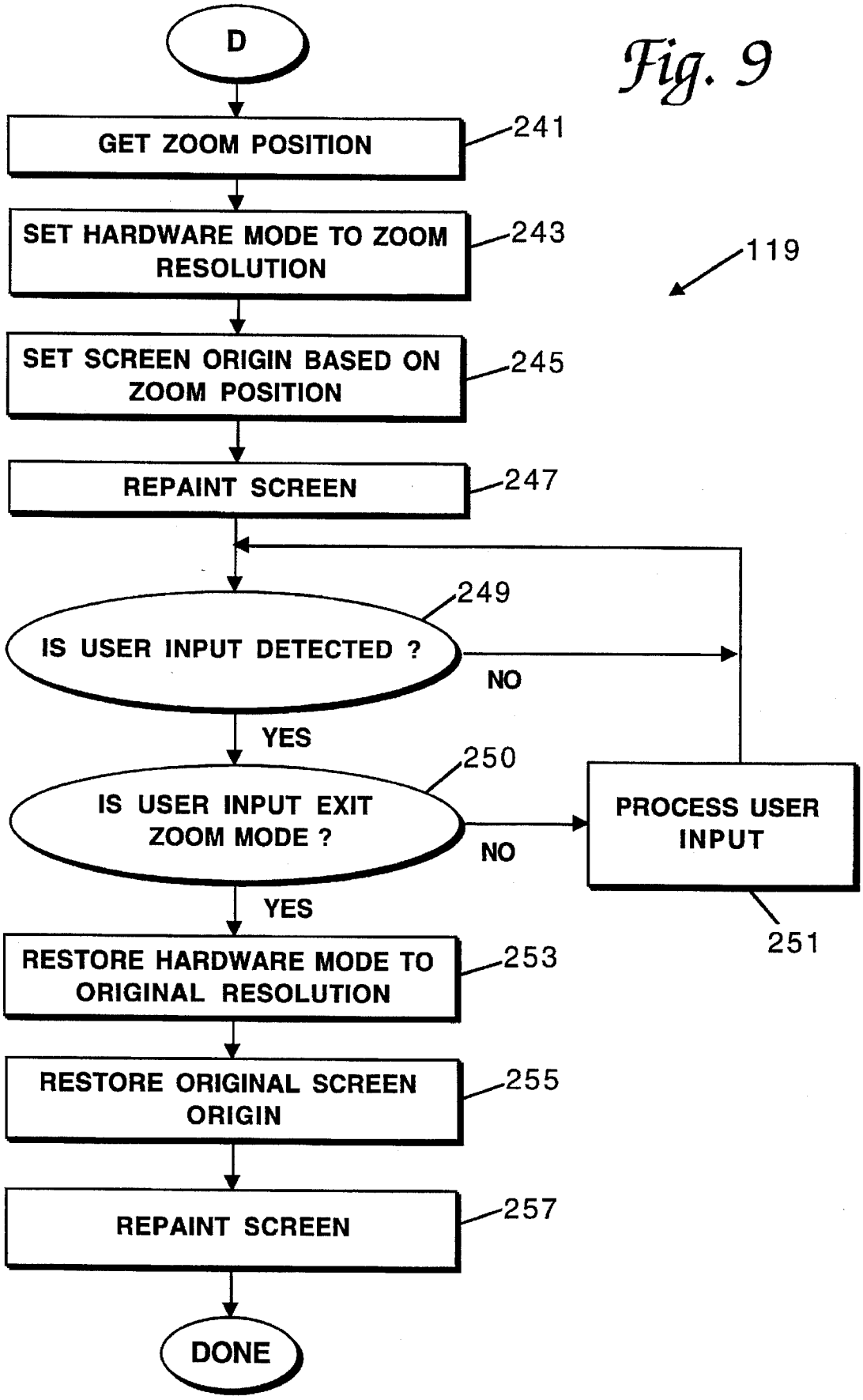
FIG. 9 is a flow diagram illustrating the process executed when the user selects a zoom operation.

Referring next to FIG. 9, the zoom step 119 will be described in more detail. When the zoom function is selected the logic initially gets the zoom position in step 241. In the described embodiment, the zoom position is considered the cursor position at the time that the zoom function is selected. However, in alternative embodiments the zoom position can be determined as a function of the cursor position or in other suitable ways. After the zoom position has been determined, the hardware mode is set to a lower resolution in step 243. In the described embodiment, the resolution is lowered to 320×200 which is a resolution supported by most monitors adapted for IBM PC compatible computers. However, in alternative embodiments other resolutions could be used. By way of example, the zoom may be arranged to change the resolution to the next lower resolution supported by the hardware, by a factor of two hardware supported resolutions etc.

After the hardware mode has been set, the screen origin is set to the zoom position (or a function thereof) in step 245 and a screen repainting command is sent in step 247. In step 245, the zoom position may typically be considered the screen origin, however, if the zoom position is such that a full screen would not be displayed with the screen origin in the zoom position, the zoom position may be moved such that a full display is provided. For example, if the zoom position is located too near the end of a document, then the screen origin can be set to display the last section of the document that can appear on the screen. The same type of position adjusting can be provided for other sides of the document as well. Alternatively, in step 245, the screen origin can be set at a position that is a function of the zoom position. By way of example, the zoom position can be considered the center of the image displayed in the zoom mode. When the screen is repainted, the image appearing on the screen will be an enlarged view of the portion of the screen that is positioned adjacent the zoom position.

Within the zoom mode, the user is free to move the cursor about the screen and to edit the document. In most instances, when the desktop is displayed in the zoom mode it will be larger than the available screen space. Thus, the system acts like a virtual desktop wherein display can be scrolled or moved horizontally by moving the cursor beyond the screen boundaries. Therefore, in step 249, the logic waits for the next user input. As long as no user input in detected, the screen display will remain unchanged. When a user input is detected, the logic determines whether the input is an exit zoom mode command in step 250. A wide variety of actions can be used as exit zoom mode commands. By way of example, a designated keystroke and/or clicking on the zoom icon 54 while in the zoom mode can be considered exit zoom mode commands. If the zoom mode has not been exited, the user input is processed in step 251 in a normal manner. On the other hand, if the zoom mode is exited, then in step 253, the hardware mode is restored to the original resolution. The origin is restored to its original position in step 255, and a repaint screen command is issued in step 257. At this point the zoom operation is completed.

Figure 10:
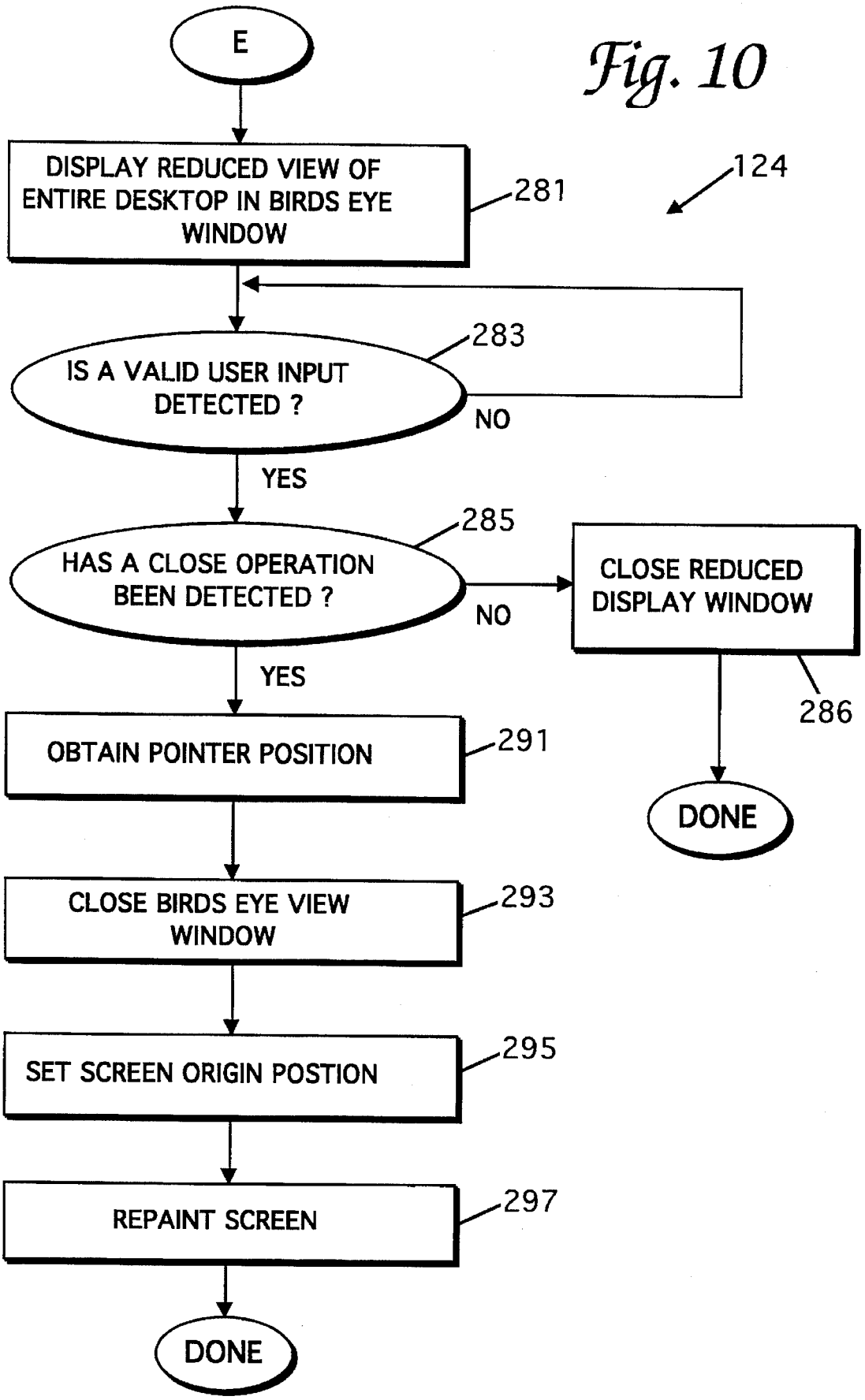
FIG. 10 is a flow diagram illustrating the process executed when the user selects a birds eye view operation.
Figure 11A:
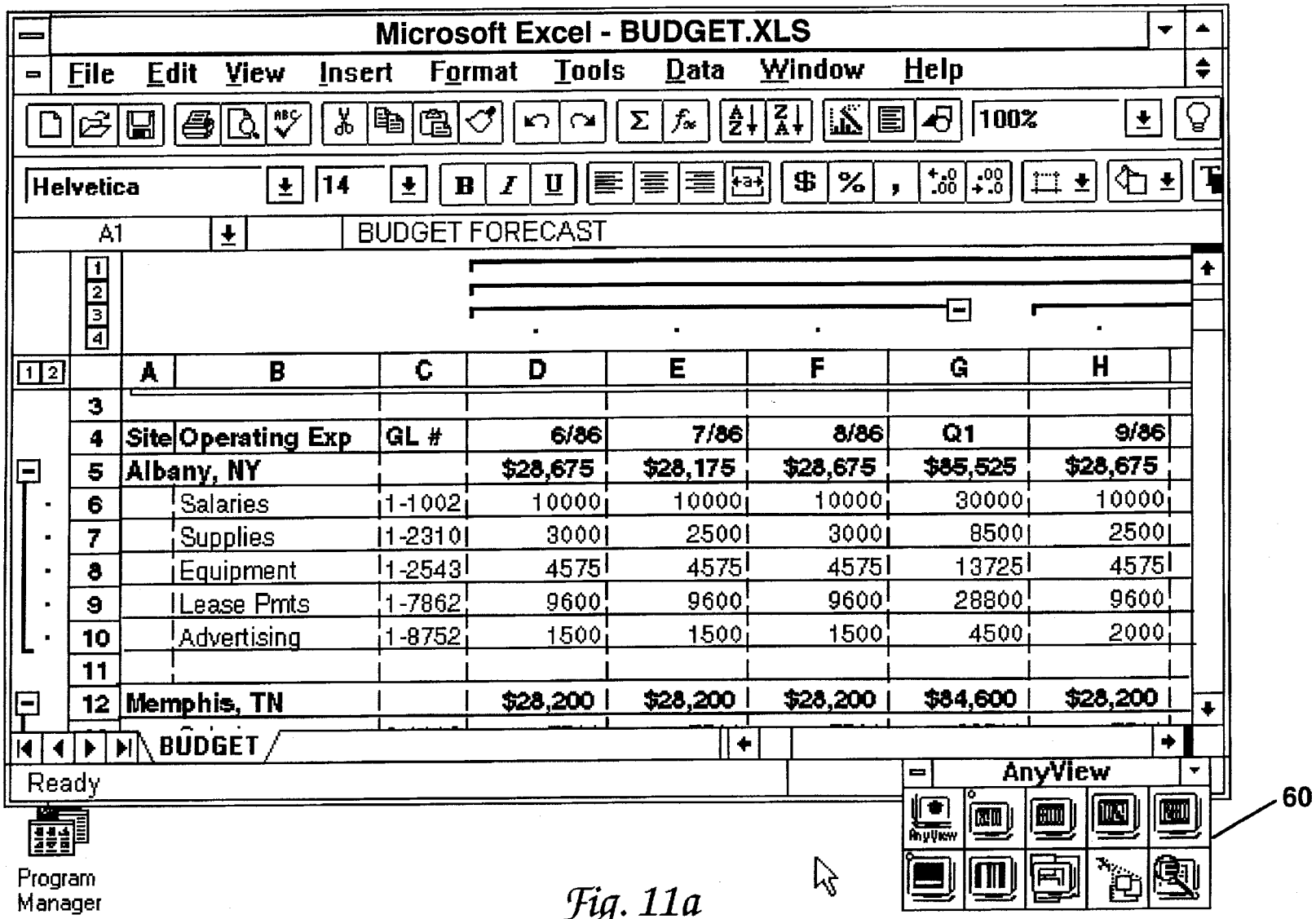
FIG. 11*a* is a screen display of a Windows session running an application program with the screen resolution set at a 640×480 resolution.
Figure 11C:
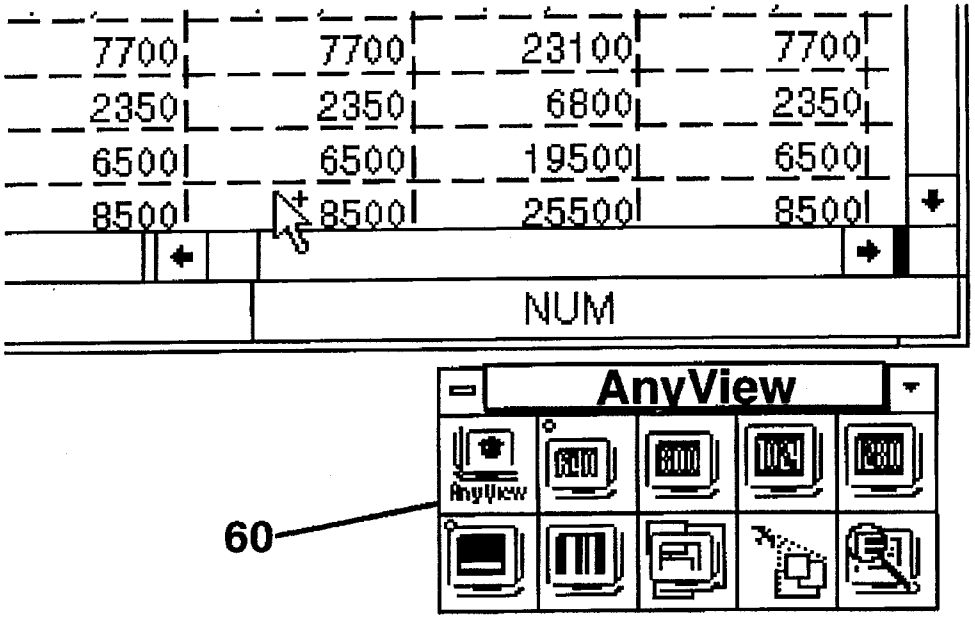
FIG. 11*c* is a screen display of a Windows session running the application program shown in FIG. 11*a* in the zoom mode.
Figure 12A:
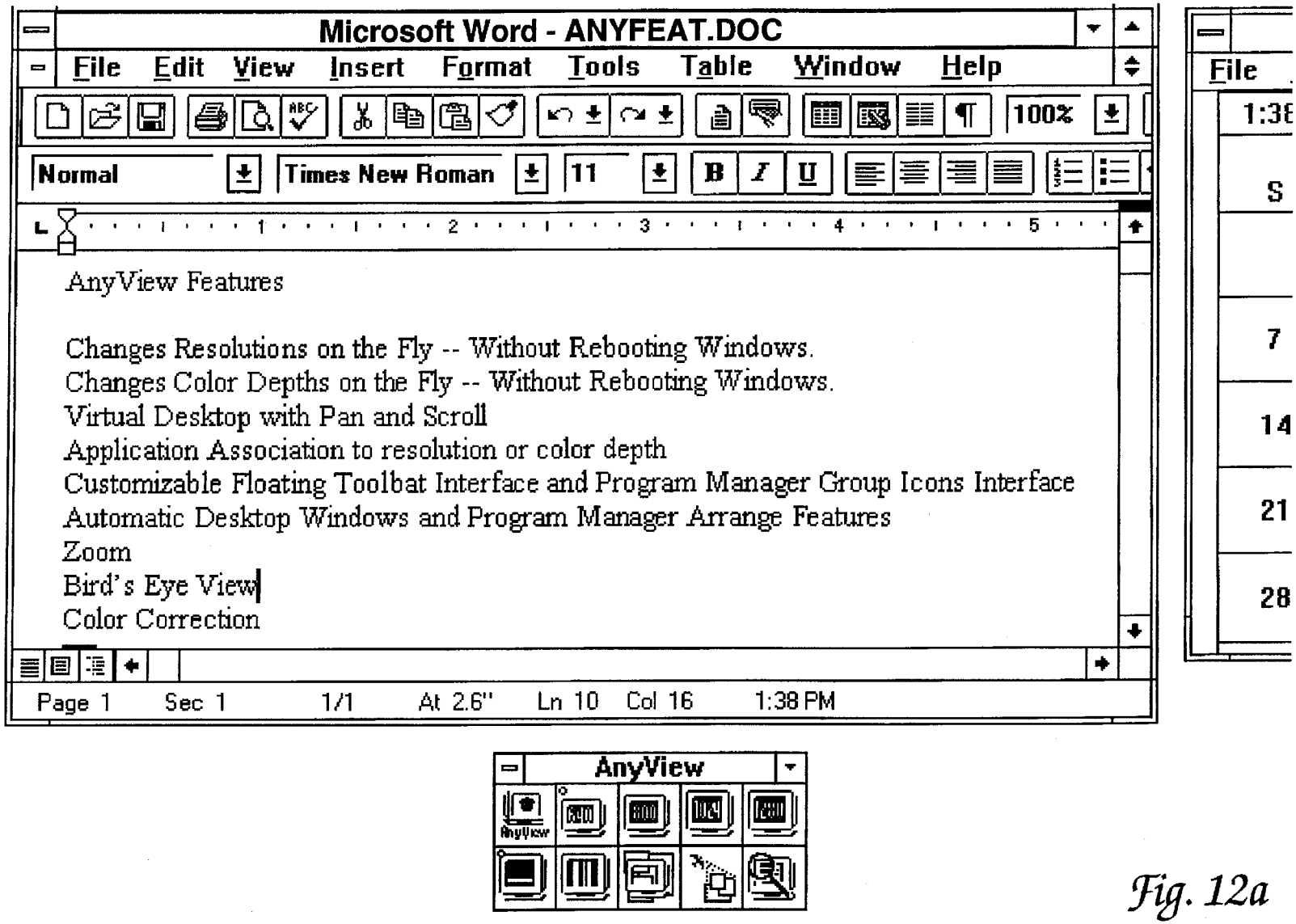
FIG. 12*a* is a screen display of a Windows session running various application programs wherein the display monitor is in a 1024×768 virtual desktop mode with a 640×480 screen resolution displayed.
Figure 12B:
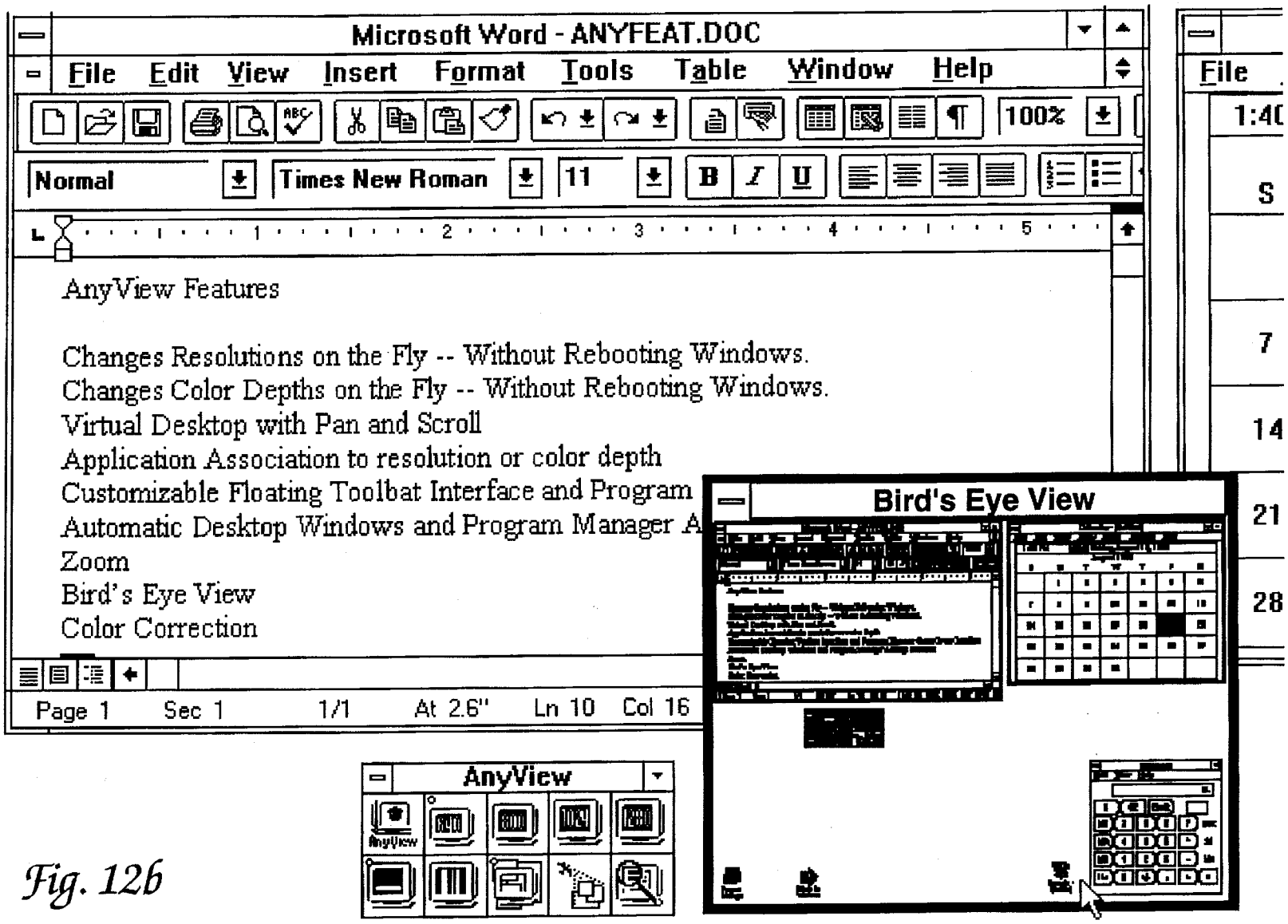
FIG. 12*b* is a screen display of a virtual desktop as seen in FIG. 12*a* with the birds eye view feature of the present invention selected.
Figure 12C:
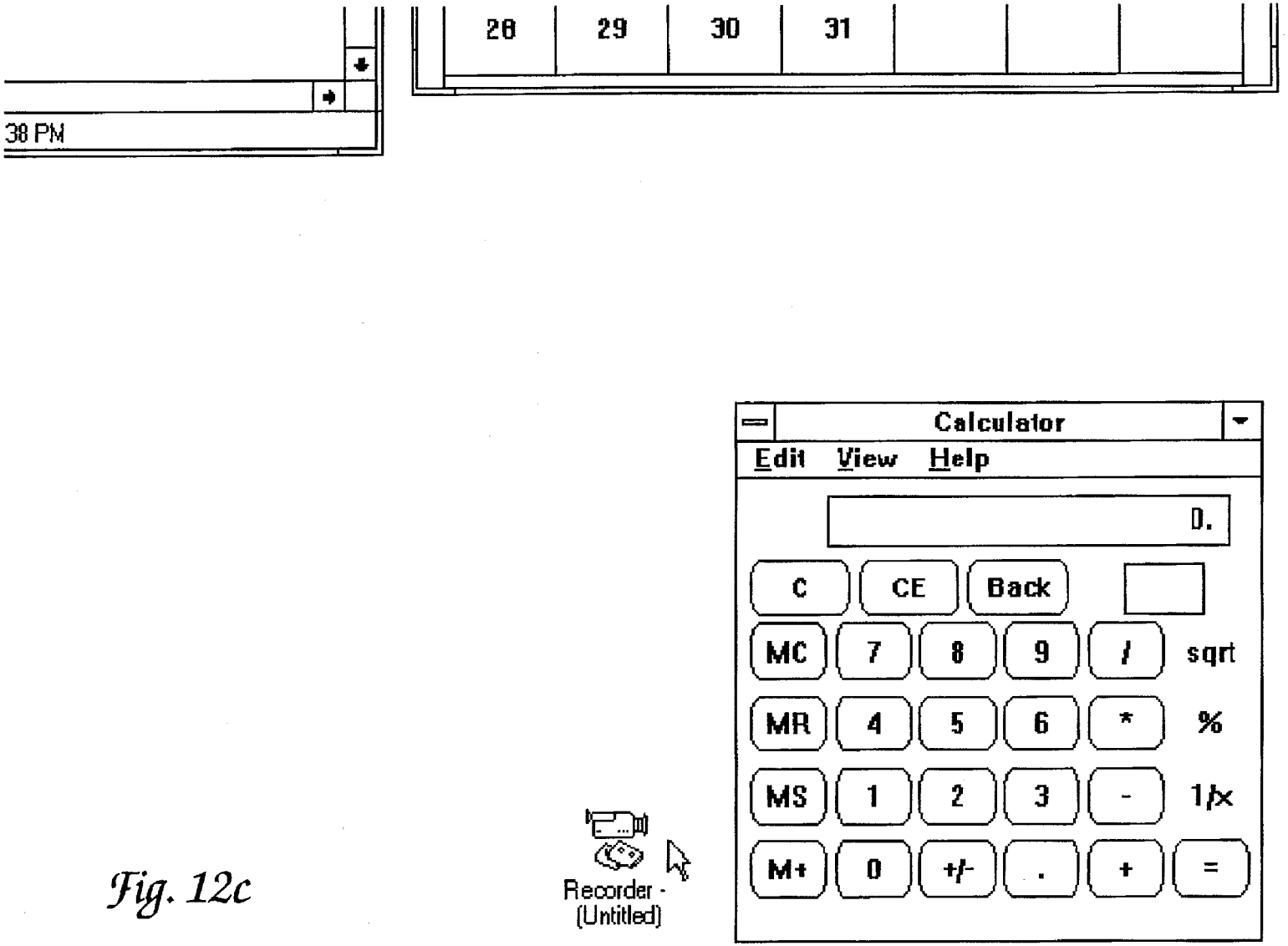
FIG. 12*c* is a screen display of a virtual desktop as seen in FIG. 12*a* after the screen origin has been moved using the birds eye view feature of the present invention.

Referring next to FIG. 10, the birds eye view operation 124 will be described in more detail. As described above, the birds eye view operation is intended to be used in conjunction with the virtual desktop. Initially, after a birds eye view icon 58 has been selected, a reduced sized view of the entire desktop is displayed in a window as seen in FIG. **12*b*. Step 281. The birds eye view display window 80 is typically smaller than the entire screen display as best seen in FIG. 12*b*. After the reduced view has been displayed, the logic determines whether a valid user input has been made in step 283. To be valid, the user input must be a point and click operation located within the birds eye view window 80 which serves to select a location, or a close window operation. If a valid input has not been made, the system will wait for a user input. Once a valid user input has been detected, the process moves to step 285 where it is determined whether the user has selected a close operation. This may be done in any conventional manner. By way of example in a system adapted for use with Windows, a close operation may be selected by any of three manners. They include, selecting close from a pull down menu, using a mouse based pointer to point and click on a close box and closing using a keyboard command. If a close operation has been selected, then the birds eye view display window 80 is closed and removed from the display screen in step 286** and the process is completed.

On the other hand, if the user has selected a position within the birds eye view window 80 using the pointer, then the logic obtains the pointer position in step 291. Thereafter, the birds eye view window 80 is closed in step 293, the screen origin is changed to the selected cursor position in step 295 and the screen display is repainted in step 297. In the event that the selected position is a position that is beyond the edge to which the screen could normally be scrolled in a particular direction, the screen display in that direction is positioned as far in that direction as can be normally scrolled. After the display has be repainted, the process is completed.

Although only one embodiment of the present invention has been described in detail, it should be understood that the present invention may be embodied in many other specific forms without departing from the spirit or scope of the invention. Particularly, in many instances, the ordering of the steps can be altered without defeating the purpose of the invention. For example, in the resolution and color depth changing routines, the order in which the operating system display characteristic variables, the driver display characteristic variable and the hardware mode are set are unimportant.

The invention has been described in conjunction with an IBM PC compatible personal computer using an MS-DOS based Windows operating system. However, the invention can also be adapted for use with other computers and operating systems as well. Numerous screen display controlling features have been described and are claimed in the subsequent claims. However, it should be appreciated that these features are separable and need not be combined into a single package. Therefore, the present examples are to be considered as illustrative and not restrictive, and the invention is not to be limited to the details given herein, but may be modified within the scope of the appended claims.

We claim:

1. A screen display mode changer suitable for use in a computer system that includes a display monitor including a screen, a display driver arranged to control a characteristic of images displayed on the screen, the display driver being arranged to support a plurality of different display modes, and a processing arrangement suitable for executing a designated windowing based operating system including USER and GDI data segments and executing a designated graphical user interface (GUI) based application program on the designated operating system, the screen display mode changer comprising:

means for setting operating system display characteristic variables in the USER and GDI data segments to values that are appropriate for a requested display mode that is requested while the windowing based operating system and the designated GUI based application program arranged to run on the windowing based operating system are open and controlling the contents of a window visible on the screen;

means for setting display driver display characteristic variables of the display driver to values that are appropriate for the requested display mode, wherein the display driver works with but is independent of the designated operating system and the designated application program;

means for setting a hardware mode to a mode that is appropriate for the requested display mode; and means for refreshing the screen to cause the screen to display the window in the requested display mode;

wherein the operating system display characteristic variable setting means, the display driver display characteristic setting means and the hardware mode setting means are each capable of performing their designated functions without requiring that either the selected application program or the selected operating system be exited.

2. A screen display mode changer as recited in claim 1 wherein the designated operating system is a Windows based operating system and the hardware mode change is accomplished in DOS.

3. Computer software for resetting a screen display mode in a computer system running Microsoft Windows without requiring that either Windows or a graphical user interface based application program that is currently running on Windows to be exited and reloaded, wherein Windows includes USER and GDI data segments, the computer system including a processing arrangement, and a display monitor which displays images under the direction of the processing arrangement, the software being arranged to:

permit the processing arrangement to receive an input requesting a change in the display mode while Windows is running;

set Windows operating system display characteristic variables in the USER and GDI data segments to values that are appropriate for the requested display mode when a display mode change request is received;

set display driver display characteristic variables to values that are appropriate for the requested display mode when a display mode change request is received;

set a hardware mode to a mode that is appropriate for the requested display mode when a display mode change request is received; and refresh the display screen to display images dictated by Windows and the GUI based application program currently running on Windows, whereby the screen display mode may be reset without requiring that the Windows or the application program that is currently running on Windows to be exited.

4. Computer software as recited in claim 3 for use in a computer system having a display monitor that can display a variety of screen resolutions, wherein the display mode changed is the screen resolution.

5. Computer software as recited in claim 3 for use in a computer system having a display monitor that can display a variety of color depths, wherein the display mode changed is the color depth.

6. Computer software as recited in claim 3 wherein:

when a new application program is selected within the Windows environment, the software is further arranged to check to determine whether the newly open application program has a desired display mode associated therewith;

when the selected application has a desired display mode associated therewith, the software is arranged to check to determine whether the desired display mode is different from the current display mode; and when the desired display mode is different from the current display mode, the software is arranged to reset the Windows operating system display characteristics, the display driver display characteristic variables and the hardware mode and refresh the display screen.

7. A method of resetting a screen display mode in a computer system having a display monitor, the display mode being reset while a designated operating system is running, without requiring the designated operating system or an application program that is currently open in the designated operating system to be exited and reloaded, the method comprising the steps of:

receiving a request for a change in the display mode while the application program is open such that it dictates the contents of a window appearing on the display monitor:

setting operating system display characteristic variables to values that are appropriate for the requested display mode;

setting display driver display characteristic variables to values that are appropriate for the requested display mode;

setting the hardware mode to a mode that is appropriate for the requested display mode; and refreshing the display screen to display images dictated by the designated operating system and the application program that is currently open in the requested display mode, whereby the display mode is reset without requiring that the application program be exited.

8. A method as recited in claim 7 wherein the requested display mode is a new display resolution.

9. A method as recited in claim 7 wherein the requested display mode is a new color depth and the display characteristic variables include color depth variables.

10. A method as recited in claim 7 further comprising the steps of:

determining whether a desired display mode is different from the current display mode;

when the desired display mode is different from the current display mode, executing said setting and refreshing steps; and wherein when the desired display mode is the same as the current display mode, the setting and refreshing steps are not executed.

11. A method of resetting a display driver display mode in a computer system having a display monitor, the display driver display mode being reset while a designated operating system is running, without requiring the operating system or an application program that is currently open in the operating system to be exited and reloaded, the method comprising the steps of:

receiving a request for a change in the display mode while the application program is open and dictating the contents of a window displayed on the display monitor;

setting display driver display characteristic variables to values that are appropriate for the requested display mode;

setting a hardware mode to a mode that is appropriate for the requested display mode; and wherein the display driver display resetting method is arranged for use in connection with a method of resetting a display mode in the computer system which includes the steps of setting operating system display characteristic variables to values that are appropriate for the requested display mode and refreshing the display screen to display images dictated by the application program that is currently open in the requested display mode, whereby the display mode is reset without requiring that the application program be exited.

12. A method of resetting a display mode in a computer system having a display monitor, the display mode being reset while a designated Windows based operating system that includes USER and GDI data segments is running, without requiring the operating system or an application program that is currently open in the operating system to be exited and reloaded, the method comprising the steps of:

receiving a request for a change in the display mode while the application program is open;

setting operating system display characteristic variables to values that are appropriate for the requested display mode, the operating system display characteristic variable setting step including setting operating system display characteristic variables in the USER and GDI data segments;

refreshing the display screen to display images dictated by the Windows based operating system and the application program that is currently open in the requested display mode, whereby the display mode is reset without requiring that the application program be exited; and wherein the display resetting method is arranged for use in connection with a method of resetting a display driver display mode which includes the steps of setting display driver display characteristic variables to values that are appropriate for the requested display mode and setting a hardware mode to a mode that is appropriate for the requested display mode.

13. A computer system comprising:

a display monitor including a screen display;

a display driver arranged to control the images displayed on the screen display, the display driver being arranged to support a plurality of different display resolutions;

a processing arrangement suitable for executing a Windows based operating system that includes USER and GDI data segments and executing a designated Windows based application program on the designated operating system;

means for resetting a screen display mode when a display mode change request is received, while the Windows based operating system is running, without requiring the operating system or a Windows based application program that is currently open in the operating system to be exited and reloaded, the display mode setting means being arranged to, set operating system display characteristic variables in the USER and GDI data segments to values that are appropriate for the requested display mode;

set display driver display characteristic variables to values that are appropriate for the requested display mode when a display mode change request is received;

set a hardware mode to a mode that is appropriate for the requested display mode when a display mode change request is received; and cause the display screen to be refreshed to display images dictated by the operating system and the application program that is currently open on the operating system, whereby the screen display mode may be reset without requiring that the operating system or the application program that is currently open to be exited.

14. A screen display mode changer suitable for use in a computer system that includes a display monitor including a screen, a display driver arranged to control a characteristic of images displayed on the screen, the display driver being arranged to support a plurality of different display modes, and a processing arrangement suitable for executing a designated windowing based operating system and executing a designated application program on the designated operating system, the screen display mode changer comprising:

means for setting operating system display characteristic variables to values that are appropriate for a requested display mode that is requested while a selected windowing based operating system and a selected application program arranged to run on the windowing based operating system are open;

means for setting display driver display characteristic variables of a display driver that works with but is independent of the selected operating system and the selected application program to values that are appropriate for the requested display mode;

means for setting a hardware mode to a mode that is appropriate for the requested display mode; and wherein the operating system display characteristic variable setting means, the display driver display characteristic setting means and the hardware mode setting means are each capable of performing their designated functions without requiring that either the selected application program or the selected operating system be exited.

15. A screen display mode changer as recited in claim 14 wherein the designated operating system is a Windows based operating system and the hardware mode change is accomplished in DOS.

16. A method of resetting a display driver display mode in a computer system having a display monitor, the display driver display mode being reset to a different display mode while a Windows operating system is running, without requiring that Windows or an application program that is currently open in Windows to be exited and reloaded, the method comprising the steps of:

receiving a request for a change in the display mode while the application program is open;

setting display driver display characteristic variables to values that are appropriate for the requested display mode;

setting a hardware mode to a mode that is appropriate for the requested display mode; and wherein the display driver display resetting method is arranged for use in connection with a method of resetting a display mode in the computer system which includes the steps of setting operating system display characteristic variables to values that are appropriate for the requested display mode and refreshing the display screen to display images dictated by the Windows and the application program that is currently open in the requested display mode, whereby the display mode is reset to a different display mode without requiring that the application program be exited.

17. A computer readable medium having programmed instructions for resetting a screen display mode in a computer system running Microsoft Windows without requiring that either Windows or an application program that is currently running on Windows to be exited and reloaded, wherein Windows includes USER and GDI data segments, the computer system including a processing arrangement, and a display monitor which displays images under the direction of the processing arrangement, the computer readable medium having programmed instructions arranged to:

permit the processing arrangement to receive an input requesting a change in the display mode while Windows is running and the Windows based application program controls the materials displayed within a first window;

set Windows operating system display characteristic variables in the USER and GDI data segments to values that are appropriate for the requested display mode when a display mode change request is received;

set display driver display characteristic variables to values that are appropriate for the requested display mode when a display mode change request is received;

set a hardware mode to a mode that is appropriate for the requested display mode when a display mode change request is received; and refresh the display screen to display images dictated by Windows and the application program currently running on Windows, whereby the screen display mode may be reset without requiring that the Windows or the application program that is currently running on Windows to be exited.

18. A computer readable medium as recited in claim 17 for use in a computer system having a display monitor that can display a variety of screen resolutions, wherein the display mode changed is the screen resolution.

19. A computer readable medium as recited in claim 17 for use in a computer system having a display monitor that can display a variety of color depths, wherein the display mode changed is the color depth.

20. Computer software for resetting a screen display mode in a computer system running a windowing based operating system with a graphic user interface (GUI) without requiring that either the operating system or a GUI based application program that is currently running on the operating system to be exited and reloaded, wherein the operating system includes USER and GDI data segments, the computer system including a processing arrangement, and a display monitor which displays images under the direction of the processing arrangement, the software being arranged to:

permit the processing arrangement to receive an input requesting a change in the display mode while the windowing based operating system is running and a GUI based application program is open and dictating the contents of a window within the windowing based operating system;

set operating system display characteristic variables in the USER and GDI data segments to values that are appropriate for the requested display mode when a display mode change request is received;

set display driver display characteristic variables in a display driver that is substantially independent of the operating system and the application program to values that are appropriate for the requested display mode when a display mode change request is received;

set a hardware mode to a mode that is appropriate for the requested display mode when a display mode change request is received; and transmit a refresh screen command to the application program to cause the application program to redraw display images in the requested display mode that are dictated by the operating system and the GUI based application program, whereby the screen display mode may be reset without requiring that the operating system or the application program that is currently running on the operating system to be exited.

21. Computer software as recited in claim 20 for use in a computer system having a display monitor that can display a variety of screen resolutions, wherein the display mode changed is the screen resolution.

22. Computer software as recited in claim 20 for use in a computer system having a display monitor that can display a variety of color depths, wherein the display mode changed is the color depth.

23. A computer readable medium having programmed instructions for resetting a screen display mode in a computer system running a windowing based operating system when an application program is opened, the computer readable medium comprising programmed instructions arranged to:

a) check to determine whether a newly selected application program has a desired display mode associated therewith;

b) check to determine whether the desired display mode is different from a current display mode when the selected application program has a desired display mode associated therewith; and c) when the desired display mode is determined to be different from the current display mode, reset the screen display mode to the desired display mode without requiring that any other open application programs be exited and reloaded, wherein the desired display mode setting is accomplished by programmed instructions arranged to, i) set operating system display characteristic variables in USER and GDI data segments associated with the windowing based operating system to values that are appropriate for the requested display mode;

ii) set display driver display characteristic variables in a display driver that is substantially independent of the operating system and the selected application program to values that are appropriate for the desired display mode;

iii) set a hardware mode to a mode that is appropriate for the desired display mode when a display mode change request is received.

24. A computer readable medium as recited in claim 23 wherein the windowing based operating system is Windows 3.1.

25. A computer readable medium as recited in claim 23 wherein the computer readable medium further comprises programmed instructions arranged to refresh the display screen.

26. A method of resetting a screen display mode in a computer system having a display monitor, the display mode being reset while a designated windowing based operating system is running, without requiring the designated operating system or an application program that is currently open in the designated operating system to be exited and reloaded, the method comprising the steps of:

receiving a request for a change in the display mode while an application program is open within the designated operating system and dictating the contents of a window appearing on the display monitor;

setting operating system display characteristic variables within the designated operating system to values that are appropriate for the requested display mode;

setting display driver display characteristic variables in a display driver that is substantially independent of the application program and operating system to values that are appropriate for the requested display mode;

setting the hardware mode to a mode that is appropriate for the requested display mode; and refreshing the display screen to display images dictated by the designated operating system and the application program that is currently open in the requested display mode, whereby the display mode is reset without requiring that the application program be exited.

27. A method as recited in claim in claim 26 wherein the operating system display characteristic variables include variables within USER and GDI data structures.

28. A method as recited in claim in claim 27 wherein the designated operating system is a Windows operating system.

29. A method as recited in claim in claim 28 wherein the designated operating system is Windows 3.1.

30. A method as recited in claim 26 wherein the requested display mode is a new display resolution.

31. A method as recited in claim 26 wherein the requested display mode is a new color depth and the display characteristic variables include color depth variables.

32. A method as recited in claim 26 further comprising the steps of:

determining whether requested display mode is different from the current display mode; and when the desired display mode is different from the current display mode, executing said setting and refreshing steps; and wherein when the desired display mode is the same as the current display mode, the setting and refreshing steps are not executed.

33. A method as recited in claim in claim 27 wherein the refreshing step includes the substep of sending a refresh screen command to the application program to cause the application program to redraw display images in the requested display mode that are dictated by the operating system and the application program.

34. A computer readable medium having programmed instructions for resetting a screen display mode in a computer system having a display monitor, the display mode being reset while a designated windowing based operating system is running, without requiring the designated operating system or an application program that is currently open in the designated operating system to be exited and reloaded, the computer readable medium comprising programmed instructions arranged to:

receive a request for a change in the display mode while an application program is open within the designated operating system and dictating the contents of a window appearing on the display monitor;

set operating system display characteristic variables within the designated operating system to values that are appropriate for the requested display mode;

set display driver display characteristic variables in a display driver that is substantially independent of the application program and operating system to values that are appropriate for the requested display mode;

set a hardware mode to a mode that is appropriate for the requested display mode; and refresh the display screen to display images dictated by the designated operating system and the application program that is currently open in the requested display mode, whereby the display mode is reset without requiring that the application program be exited.

35. A computer readable medium as recited in claim 34 wherein the operating system display characteristic variables include variables within USER and GDI data structures.

36. A computer readable medium as recited in claim 35 wherein the designated operating system is a Windows operating system.

37. A computer readable medium as recited in claim 36 wherein the designated operating system is Windows 3.1.

38. A computer readable medium as recited in claim 34 wherein the requested display mode is one of a new display resolution and a new color depth.

39. A computer readable medium as recited in claim 34 further comprising programmed instructions for:

determining whether requested display mode is different from the current display mode; and when the desired display mode is different from the current display mode, executing said setting and refreshing steps; and wherein when the desired display mode is the same as the current display mode, the programmed instructions are configured such that the setting and refreshing steps are not executed.

40. A computer readable medium as recited in claim in claim 34 wherein the computer readable instructions for refreshing the display screen include instructions for sending a refresh screen command to the application program to cause the application program to redraw display images in the requested display mode that are dictated by the operating system and the application program.

41. A computer readable medium having programmed instructions for resetting a display driver display mode in a computer system having a display monitor, a designated windowing based operating system, and a display driver that is substantially independent of the windowing based operating system, the computer readable medium comprising programmed instructions arranged to:

receive a request for a change in the display mode while an application program is open and dictating the contents of a window displayed on the display monitor;

set display driver display characteristic variables in the display driver to values that are appropriate for the requested display mode;

set a hardware mode to a mode that is appropriate for the requested display mode; and wherein the instructions for resetting the display driver display mode are arranged for use in connection with an arrangement for resetting a display mode in the computer system which sets operating system display characteristic variables to values that are appropriate for the requested display mode and refreshing the display screen to display images dictated by the application program in the requested display mode, whereby the display mode is reset such that at least some of the contents of the window are displayed in the new display mode without requiring that the application program be exited and reloaded.

42. A computer readable medium as recited in claim 41 wherein the operating system display characteristic variables include variables within USER and GDI data structures.

43. A computer readable medium as recited in claim 42 wherein the designated operating system is a Windows operating system.

44. A computer readable medium as recited in claim 43 wherein the designated operating system is Windows 3.1.

45. A computer readable medium as recited in claim 41 wherein the requested display mode is one of a new display resolution and a new color depth.

46. A computer readable medium as recited in claim in claim 41 wherein the computer readable instructions for refreshing the display screen include instructions for sending a refresh screen command to the application program to cause the application program to redraw display images in the requested display mode that are dictated by the operating system and the application program.

47. A computer readable medium having programmed instructions for resetting a display mode in a computer system arranged to execute a windowing based operating system, the computer system including a display monitor and a display driver that is substantially independent of the windowing based operating system, the computer readable medium comprising programmed instructions arranged to:

receive a user initiated request for a change in the display mode while an application program is open and dictating the contents of a window displayed on the display monitor;

set operating system display characteristic variables in USER and GDI data segments of the windowing based operating system to values that are appropriate for the requested display mode;

refresh the display screen to display images dictated by the windowing based operating system and the application program in the requested display mode, whereby the display mode is reset without requiring that the application program be exited; and wherein the programmed instructions are arranged for use in connection with an arrangement for resetting a display driver display mode of the display driver which sets display driver display characteristic variables of the display driver to values that are appropriate for the requested display mode and setting a hardware mode to a mode that is appropriate for the requested display mode.

48. A computer readable medium as recited in claim 47 wherein the operating system is a Windows operating system.

49. A computer readable medium as recited in claim 48 wherein the designated operating system is Windows 3.1.

50. A computer readable medium as recited in claim 47 wherein the requested display mode is one of a new display resolution and a new color depth.

51. A computer readable medium as recited in claim 47 further comprising programmed instructions for:

determining whether requested display mode is different from the current display mode; and when the desired display mode is different from the current display mode, setting the operating system display characteristic variables; and wherein when the desired display mode is the same as the current display mode, the programmed instructions are configured such that the operating system display characteristic variables setting is not performed.

52. A computer readable medium as recited in claim in claim 47 wherein the computer readable instructions for refreshing the display screen include instructions for sending a refresh screen command to the application program to cause the application program to redraw display images in the requested display mode that are dictated by the operating system and the application program.

53. A computer system comprising:

a display monitor including a screen display;

a display driver arranged to control the images displayed on the screen display, the display driver being arranged to support a plurality of different display resolutions;

a processing arrangement suitable for executing a windowing based operating system that includes USER and GDI data segments and executing a designated graphical user interface (GUI) based application program on the operating system;

means for resetting a screen display mode when a display mode change request is received, while the operating system is running, without requiring the designated application program that is currently dictating the contents of a window displayed on the display monitor to be exited and reloaded, the display mode setting means being arranged to, set operating system display characteristic variables in the USER and GDI data segments to values that are appropriate for the requested display mode;

set display driver display characteristic variables in the display driver to values that are appropriate for the requested display mode when the display mode change request is received;

set a hardware mode to a mode that is appropriate for the requested display mode when the display mode change request is received; and cause the display screen to be refreshed to display images dictated by the operating system and the application program, whereby the screen display mode may be reset without requiring the application program that is currently dictating the contents of a window displayed on the display monitor to be exited.

54. A computer system as recited in claim 53 further comprising means for check to determine whether a newly selected application program has a desired display mode associated therewith and if so, determining whether the desired display mode is different from a current display mode and issue a display mode change request to the means for resetting a screen display mode is further configured to reset the current display mode to the desired display mode.

55. A method of resetting a display driver display mode in a computer system having a display monitor, the display driver display mode being reset to a different display mode while a windowing based operating system is running, without requiring that the windowing based operating system or a graphical user interface (GUI) based application program that is currently open in the windowing based operating system such that it dictates the contents of a window displayed on the display monitor to be exited and reloaded, the method comprising the steps of:

receiving a request for a change in the display mode while the application program is open and dictating the contents of a window displayed on the display monitor;

setting display driver display characteristic variables to values that are appropriate for the requested display mode;

setting a hardware mode to a mode that is appropriate for the requested display mode; and wherein the display driver display resetting method is arranged for use in connection with a method of resetting a display mode in the computer system which includes the steps of setting operating system display characteristic variables to values that are appropriate for the requested display mode and refreshing the display screen to display images dictated by the windowing based operating system and the GUI based application program that is currently open in the requested display mode, whereby the display mode is reset to a different display mode without requiring that the application program be exited.

56. A computer readable medium having programmed instructions for resetting a screen display mode in a computer system running Microsoft Windows without requiring that either Windows or an application program that is currently running on Windows to be exited and reloaded, wherein Windows includes USER and GDI data segments, the computer system including a processing arrangement, and a display monitor which displays images under the direction of the processing arrangement, the computer readable medium having programmed instructions arranged to:

permit the processing arrangement to receive an input requesting a change in the display mode while Windows is running and the Windows based application program controls the materials displayed within a first window;

set Windows operating system display characteristic variables in the USER and GDI data segments to values that are appropriate for the requested display mode when a display mode change request is received;

set display driver display characteristic variables to values that are appropriate for the requested display mode when a display mode change request is received;

set a hardware mode to a mode that is appropriate for the requested display mode when a display mode change request is received; and refresh the display screen to display images dictated by Windows and the application program currently running on Windows, whereby the screen display mode may be reset without requiring that the Windows or the application program that is currently running on Windows to be exited.

57. A computer readable medium as recited in claim 56 for use in a computer system having a display monitor that can display a variety of screen resolutions, wherein the display mode changed is the screen resolution.

58. A computer readable medium as recited in claim 56 for use in a computer system having a display monitor that can display a variety of color depths, wherein the display mode changed is the color depth.

* * * * *